US005938317A

United States Patent [19]

Thornton

[11] Patent Number: 5,938,317

[45] Date of Patent: Aug. 17, 1999

[54] LIGHTING FIXTURE WITH INTERNAL GLARE AND SPILL CONTROL ASSEMBLY

[75] Inventor: Gerry F. Thornton, Christiansburg, Va.

[73] Assignee: Hubbell Incorporated, Orange, Conn.

[21] Appl. No.: 08/654,733

[22] Filed: May 29, 1996

[51] Int. Cl.[6] ..... F21V 7/00

[52] U.S. Cl. ..... 362/290; 362/297; 362/346

[58] Field of Search ..... 362/290, 296, 362/293, 297, 346

[56] References Cited

U.S. PATENT DOCUMENTS

| | | | |
|---|---|---|---|
| 2,040,821 | 5/1936 | Benjamin | 240/3 |
| 2,142,467 | 1/1939 | Waterbury | 240/3 |
| 4,725,934 | 2/1988 | Gordin | 362/298 |
| 4,947,303 | 8/1990 | Gordin et al. | 362/261 |
| 5,016,150 | 5/1991 | Gordin et al. | 362/263 |
| 5,075,828 | 12/1991 | Gordin et al. | 362/297 |
| 5,161,883 | 11/1992 | Gordin et al. | 362/263 |
| 5,211,473 | 5/1993 | Gordin et al. | 362/297 |
| 5,313,379 | 5/1994 | Lemons et al. | 362/298 |

OTHER PUBLICATIONS

"Ultra Sport Floodlight", Specification Guide, pp. 1–4, Sep. 1993, General Electric Lighting Systems.

"Series 870 Area Lighting", 1983, Sterner.

"Professional Series", Specification / Installation Guide, pp. 1–8, 1993, Qualite Sports Lighting, Inc.

"MVF 024 Floodlight", Philips Lighting. (updated prior to May 1996).

"Stadialux Narrow Beam Symmetrical Floodlight Projector", Zumtobel Lighting The Way.

"The Brilliant Solution In Sports Lighting", Performance Profile, Mar. 1989, Philips Lighting.

"Glare In Outdoor Sports Lighting", A–Summary–2—A Summary–4, Jun. 1991.

"Level–8, Sportscluster.2", pp. 1–3, 1993, Musco; "Remote Ballast/Level–8".

Sportscluster, pp. 1–3, 1993, Musco; "Sportscluster.2", pp. 1–3, 1993, Musco.

"Excitement & Technology", *News Bulletin,* 1994, Musco; "Gym–Pak", 1993.

Musco Product Guide.

Musco, Sports–Lighting, Inc., *Product Guide,* Oct. 1981.

"A complete Guide To The Language Of Lighting", Halo Lighting Division, 1983.

"The Optical Design Of Reflectors", John Wiley & Sons, 1980, p. 196.

"Illuminating Engineering Society", *IES Lighting Handbook, The Standard Lighting Guide,* Fourth Edition—1966, pp. 19–20.

"Lighting For Athletic Fields Provides Cost–Effective Illumination", Jay J. Cain, Nov./Dec. 1982, p. 31.

"Lighting Design For Outdoor Sports Areas", Lamp and Equipment Basics, *The Electrical Distributor,* Jun. 1973.

Lighting Design For Outdoor Sports Areas, Baseball, Football, Softball Fields, 1973.

"Current Recommended Practice For Sports Lighting", Illuminating Engineering Society, Jul. 1968, p. 11.

"Current Recommended Practice For Sports Lighting", Feb. 1961, p. 63.

*Primary Examiner*—Laura Tso

*Attorney, Agent, or Firm*—Jerry M. Presson; David L. Tarnoff; Thomas P. Hilliard

[57] ABSTRACT

A lighting fixture for lighting a large area such as a sporting field. The lighting fixture has a bowl-shaped reflector with an internal glare and spill control assembly for aiming and controlling the light emitted therefrom. The glare and spill control assembly is located within the bowl-shaped reflector and behind the lens cover of the lighting fixture so that the glare and spill control assembly is substantially isolated from the effects of weather. The glare and spill control assembly preferably has a plurality of arc-shaped louvers located substantially in the upper half of the reflector for controlling glare and spill of the light from the lamp. The lower half of the reflector preferably has either a reflector insert for redirecting light more parallel to the central aiming axis, or a light absorbing baffle for reducing glare.

49 Claims, 20 Drawing Sheets

FIG. 3
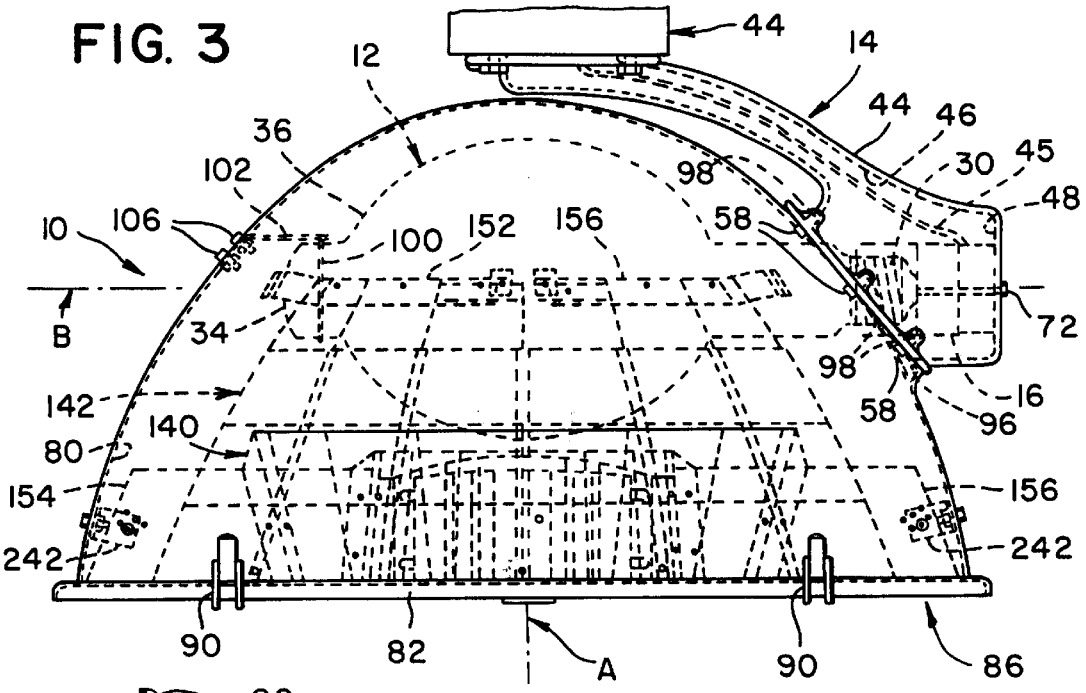
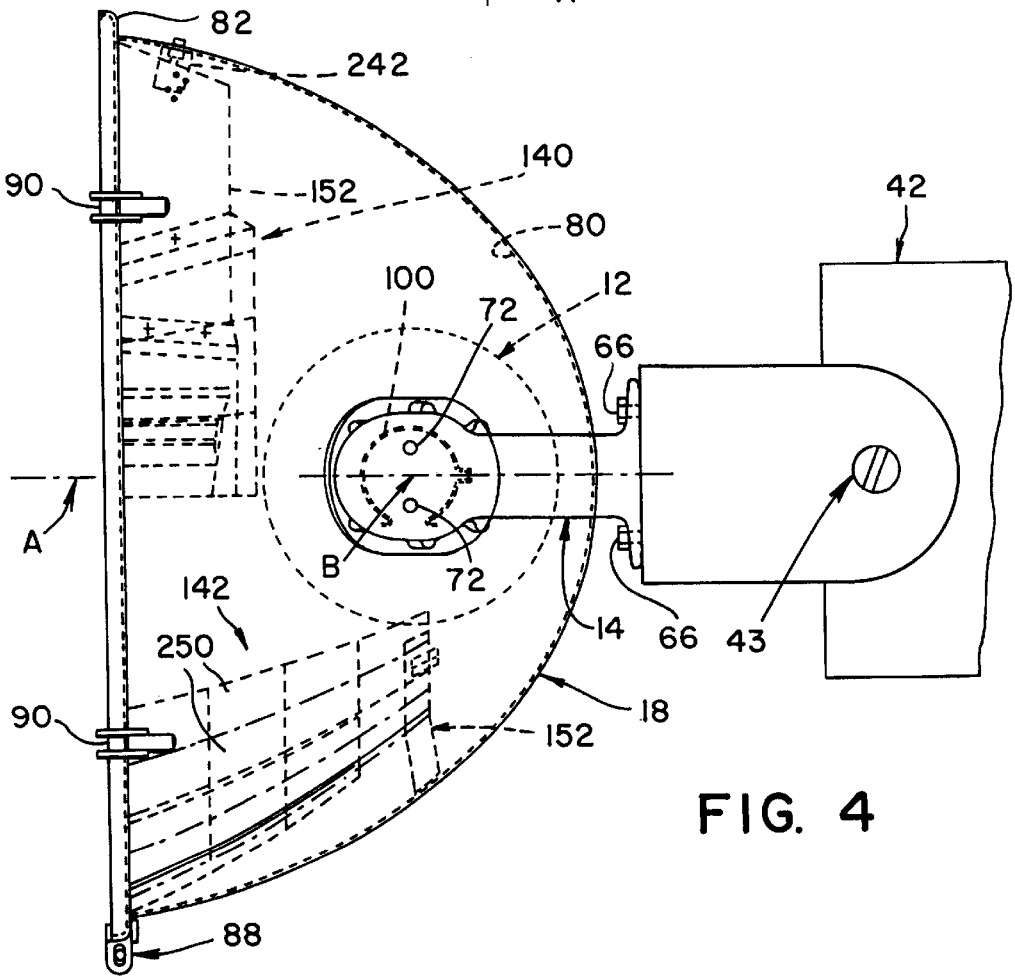
FIG. 4

LIGHTING FIXTURE WITH INTERNAL GLARE AND SPILL CONTROL ASSEMBLY

FIELD OF THE INVENTION

The present invention generally relates to controlling the light emitted from lighting fixtures which are used for lighting a large area such as sporting fields. More specifically, the present invention relates to a lighting fixture having an internal glare and spill control assembly for controlling and aiming the light emitted therefrom.

BACKGROUND OF THE INVENTION

Currently, there are many types of outdoor lighting fixtures available for lighting large areas such as parking lots, football fields, baseball diamonds, soccer fields and other types of sporting fields. The most common lighting fixtures used in floodlighting and sports lighting applications typically utilize high-intensity arc lamps such as metal halide, high pressure sodium or mercury lamps. However, most of the prior lighting fixtures currently on the market suffer from one or more disadvantages.

One of the most common types of lighting fixtures available on the market for floodlighting or sports lighting applications is the type with a symmetrical bowl-shaped reflector and an axially mounted, single-ended lamp. One common problem with such lighting fixtures is the glare produced therefrom. In the context of sports lighting and other outdoor lighting, glare occurs in these applications due to the contrast of the brightness of the light from the lighting fixture high up in the sky against the darkness of the sky. The glare can be quite annoying and discomforting. Accordingly, in sports lighting, this glare can cause a significant loss in visual performance for the viewer or fan watching the sporting event. In the case of floodlights in parking lots and along roadways, this glare can distract and obstruct a drivers' vision to sometimes cause-an accident. Moreover, the higher the intensity of the lamp, the greater the problem with glare.

In view of this glare problem, many different types of modifications to the basic lighting fixture have been proposed. Many of which work quite well in controlling glare. However, these solutions often create their own problems, and/or are often expensive or difficult to manufacture and install.

One solution to controlling glare is to use an external visor attachment, which is coupled to the exterior peripheral edge of the lighting fixture. The external visor extends outwardly from the peripheral edge of the reflector and serves to block light, whether direct or reflected from the lamp, from traveling upwardly and outwardly. While the external visor does in fact control some of the glare, it also creates its own problem. Specifically, such an external visor can increase the wind resistance of the lighting fixture. Thus, the visor can be torn off by the wind, or even worse, the entire lighting fixture can be damaged by the wind.

Another solution to controlling the glare problem is utilizing special bulbs which are either painted along their upper surface or has a special attachment thereto. However, these special bulbs and/or special attachments can be difficult to install in high locations and/or expensive to manufacture.

In addition to the glare problem, arc lamps used with these lighting fixtures suffer from a problem called "tilt factor". In particular, the arc tube of an arc lamp is generally aligned along the longitudinal axis of the lamp so that orientation of the arc tube depends upon the orientation of the lamp. Generally, the lamp and arc tube are installed along the central aiming axis of the reflector. In other words, the longitudinal axis of the arc tube is coaxial with the longitudinal axis of the arc lamp, which in turn is coaxial with the longitudinal axis of the lamp mounting socket and the reflector. Accordingly, when the lighting fixture is aimed downwardly towards the field, the lamp and arc tube are also tilted downwardly towards the field. This downward tilting of the lamp causes the heat generated by the arc tube to rise to the highest point in the lamp. In other words, the upper end of the lamp towards the socket will become hotter than the lowest point of the lamp, which is generally at the lower front end of the lamp. These temperature differences can cause precipitation of some of the loaded chemicals inside the arc tube to cause clouding and blockage of the light. This clouding and blockage of the light results in lower efficiency of the lamp. If a conventional arc lamp is tilted below horizontal position, the tilt factor can result in light output loss of up to 20% depending upon the tilt.

Some prior lighting fixtures have attempted to overcome this "tilt factor" by utilizing special lamps and/or mounting the lamp at an angle relative to the main or central aiming axis of the reflector. However, these types of lighting fixtures only maintain the arc tube in the horizontal position when the lighting fixture is tilted to a particular angle. In other words, if the lighting fixture is adjusted to any other angle, the arc tube will no longer remain horizontal.

Another problem with most lighting fixtures utilizing lamps with arc tubes is that the majority of the light emitted from the lamp towards the area to be illuminated is reflected light rather than direct light. Specifically, arc lamps emit light in such a manner that the majority of the light emitted therefrom radiates radially from its longitudinal axis. In other words, a relatively small amount of light is radiated directly from the ends of the arc tube. Accordingly, arc tubes which are mounted along the longitudinal axis or central aiming axis of the reflector typically has the end of the arc tube pointed at the area to be lighted. Thus, most of the light from these types of lighting fixtures is reflected light rather than direct light. To solve this problem, many special lamps have been developed having angled arc tubes. However, these special lamps are more expensive and must be installed properly to maximize their efficiency.

Examples of some prior lighting fixtures known in the art are disclosed in U.S. Pat. Nos.: 2,040,821 to Benjamin; U.S. Pat. No. 2,142,467 to Waterbury; U.S. Pat. No. 4,947,303 to Gordin; U.S. Pat. No. 4,725,934 to Gordin; U.S. Pat. No. 5,075,828 to Gordin; U.S. Pat. No. 5,161,883 to Gordin; U.S. Pat. No. 5,211,473 to Gordin; and U.S. Pat. No. 5,313,379 to Lemons.

In view of the above, it is apparent that there exists a need for a lighting fixture which controls glare with a minimal amount of reduction in the amount of light reaching the area to be illuminated, which maximizes the amount of light reaching the area to be illuminated, which can be retrofitted to existing reflectors, and which is relatively inexpensive and relatively easy to manufacture and install. This invention addresses these needs in the art, along with other needs which will become apparent to those skilled in the art once given this disclosure.

SUMMARY OF THE INVENTION

One object of the present invention is to provide a lighting fixture with a glare and spill control assembly for controlling and aiming the light emitted from the lamp to reduce glare and increase the efficiency of the lighting fixture.

Another object of the present invention is to provide a lighting fixture having a transversely mounted single-ended lamp with a glare and spill control assembly which achieves glare control and maximizes the amount of light reaching the area to be illuminated.

Another object of the present invention is to provide a glare and spill control assembly which is internally mounted within the reflector to avoid increasing the wind resistance of the lighting fixture.

Yet another object of the present invention is to provide a glare and spill control assembly with minimal reduction in the amount of light reaching the area to be illuminated.

Still another object of the present invention is to provide a glare and spill control assembly which can be retrofitted to existing reflectors for existing lighting fixtures.

Still yet another object of the present invention is to provide a lighting fixture with a glare and spill control assembly which is relatively inexpensive and relative easy to manufacture and install.

The foregoing objects can basically be attained by providing a lighting fixture for lighting an area, comprising a single-ended lamp having a longitudinal axis extending from a base section to a bulb section; a bowl-shaped reflector having an interior reflective surface with a central aiming axis and a front peripheral edge defining a front opening; a lamp mounting socket fixedly coupled to said reflector and electrically coupled to said base section of said lamp for supporting said lamp within said reflector; a lens cover coupled to said reflector for covering said front opening of said reflector to protect said lamp from weather; and a glare and spill control assembly coupled to said inner reflective surface of said reflector and behind said lens cover, said glare and spill control assembly including a first arc-shaped louver having an outer surface and an inner surface, said first louver being angled inwardly towards said central aiming axis of said reflector as said first louver approaches said lens cover.

The foregoing objects can also be attained by providing a lighting fixture for lighting an area, comprising a single-ended lamp having a longitudinal axis extending from a base section to a bulb section; a bowl-shaped reflector having an interior reflective surface with a central aiming axis and a front peripheral edge defining a front opening; a lamp mounting socket fixedly coupled to said reflector and electrically coupled to said base section of said lamp for supporting said lamp within said reflector, said lamp mounting socket being positioned to maintain said longitudinal axis of said lamp substantially perpendicular to said central aiming axis; a lens cover coupled to said reflector for covering said front opening of said reflector to protect said lamp from weather; and a glare and spill control assembly coupled to said inner reflective surface of said reflector and behind said lens cover.

BRIEF DESCRIPTION OF THE DRAWINGS

Referring now to the drawings which form part of this original disclosure:

FIG. 3 is a top plan view of the lighting fixture illustrated in FIGS. 1 and 2 in accordance with the present invention;

FIG. 4 is a right side elevational view of the lighting fixture illustrated in FIGS. 1–3 in accordance with the present invention;

DETAILED DESCRIPTION OF THE PREFERRED EMBODIMENT

Figure 1:
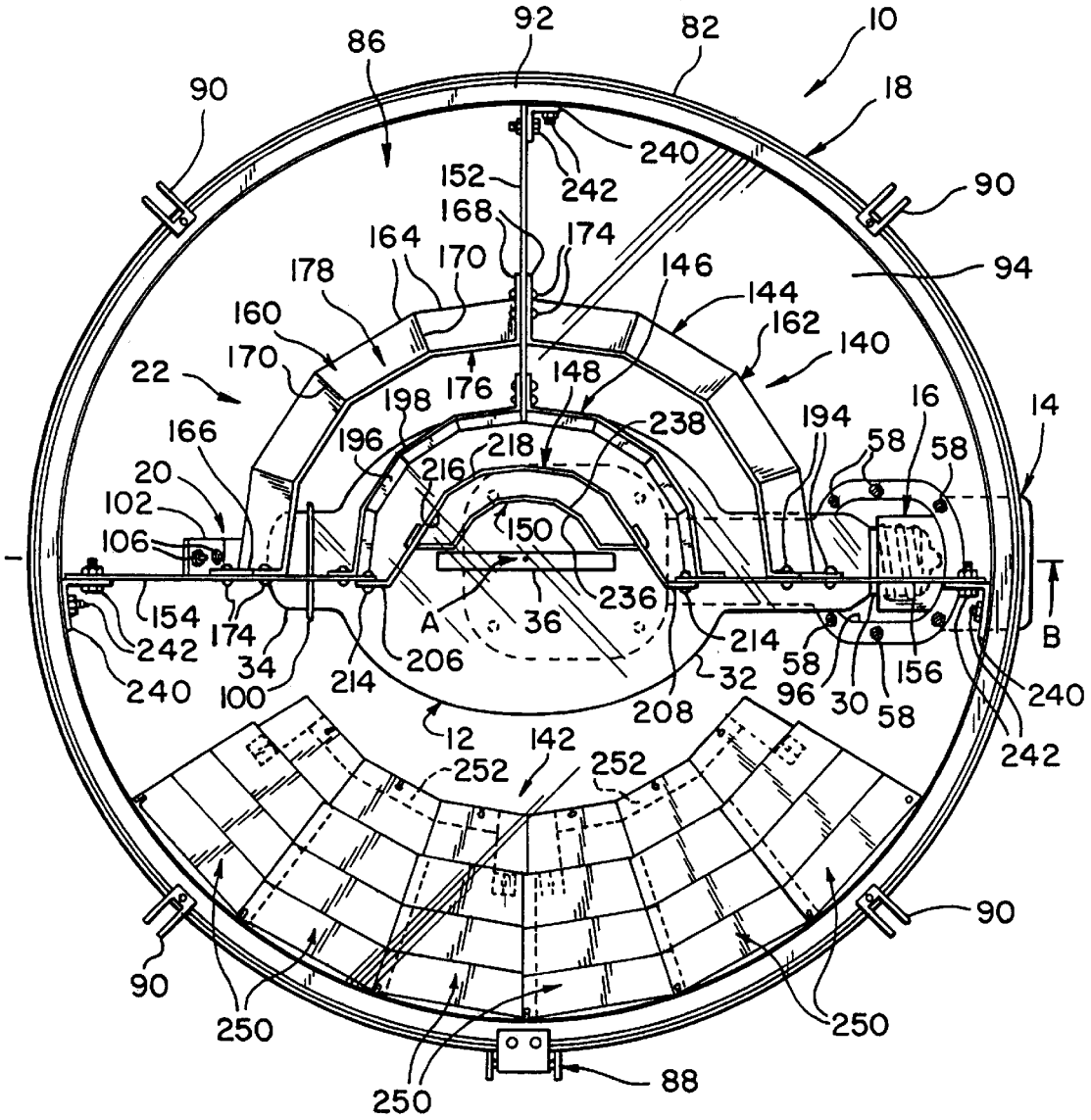
FIG. 1 is a front elevational view of a lighting fixture in accordance with the present invention including a reflector mounting arm, a lamp end support and a glare and spill control assembly.

Referring initially to FIGS. 1–4, a lighting fixture 10 in accordance with the present invention is illustrated. Lighting fixture 10 includes a single-ended lamp 12, a reflector mounting arm 14 with a lamp mounting socket 16, a bowl-shaped reflector 18 with a lamp end support 20, and a glare and spill control assembly 22. Lighting fixture 10 is especially designed to illuminate large areas such as sporting fields. In these applications, it is necessary to control the light emitted from lighting fixture 10 to avoid glare as well as to maximize the light being emitted from lamp 12. This need is accomplished in the present invention by providing a transversely mounting lamp 12 within bowl-shaped reflector 18 together with an internally mounting glare and spill assembly 22.

Moreover, lighting fixture 10 is designed so that special or non-conventional lamps are not necessary. Accordingly, lamp 12 is preferably, a conventional single-ended lamp which is typically used in floodlighting type applications. For example, lamp 12 can be either a metal halide lamp, a mercury lamp or a high pressure sodium lamp. Of course, it will be apparent to those skilled in the art that other types of single-ended lamps could be utilized with lighting fixture 10 in accordance with the present invention. The lamp 12 as illustrated in the drawings is preferably a BT-56 lamp.

Figure 2:
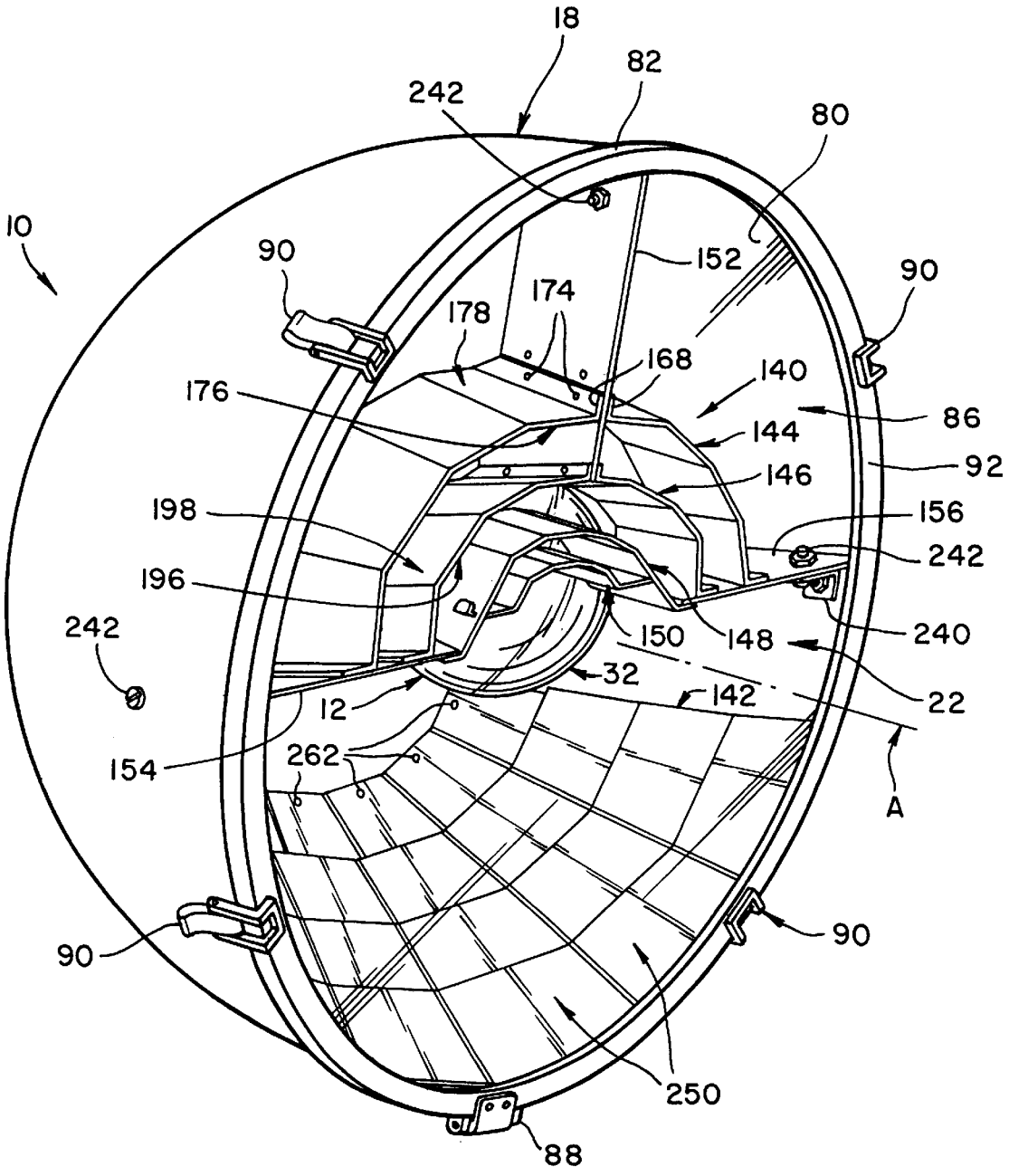
FIG. 2 is a perspective view of the lighting fixture illustrated in FIG. 1 in accordance with the present invention.
Figure 5:
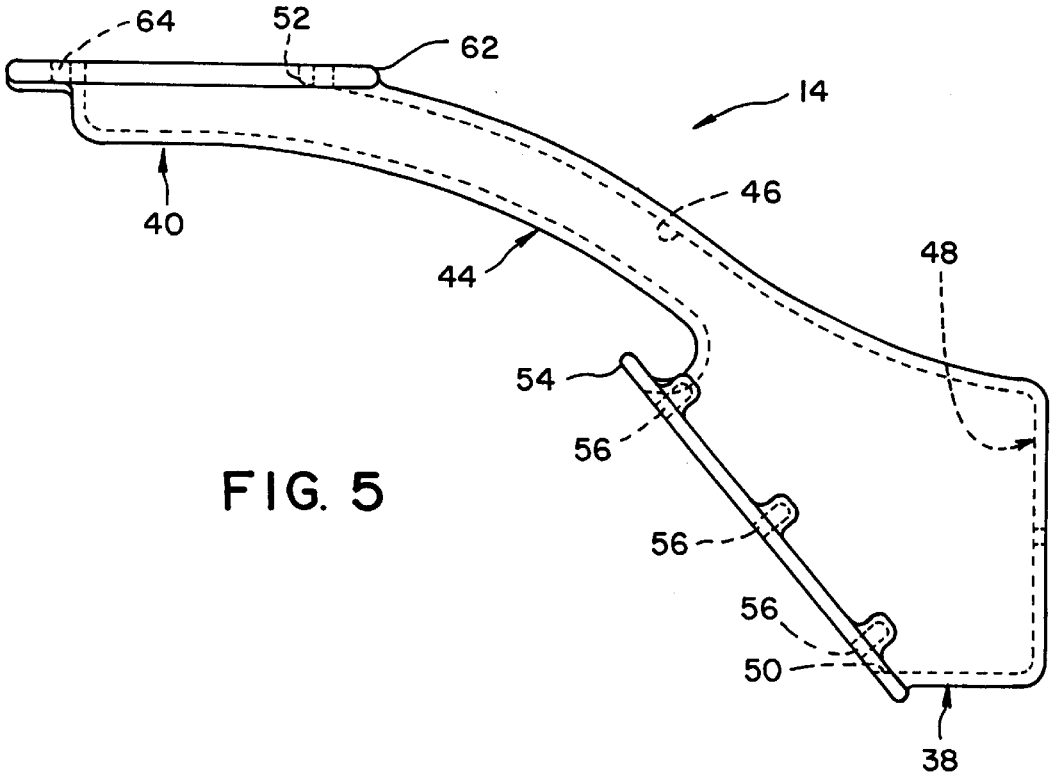
FIG. 5 is a top plan view of the reflector mounting arm for the lighting fixture illustrated in FIGS. 1–4 in accordance with the present invention.
Figure 6:
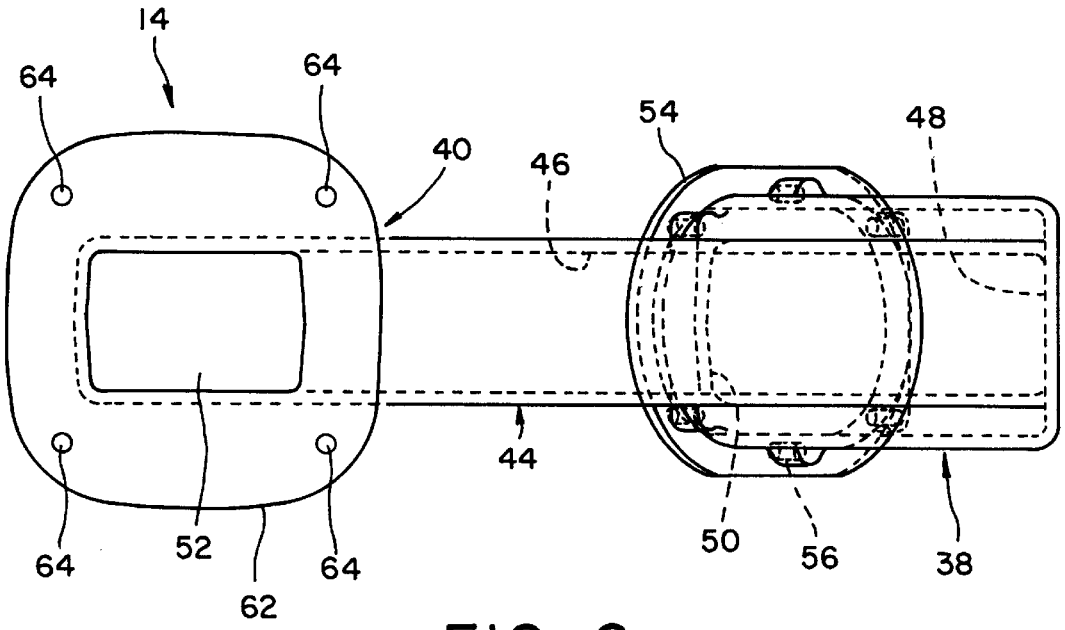
FIG. 6 is a rear elevational view of the reflector mounting arm illustrated in FIG. 5 for the lighting fixture illustrated in FIGS. 1–4 in accordance with the present invention.
Figure 7:
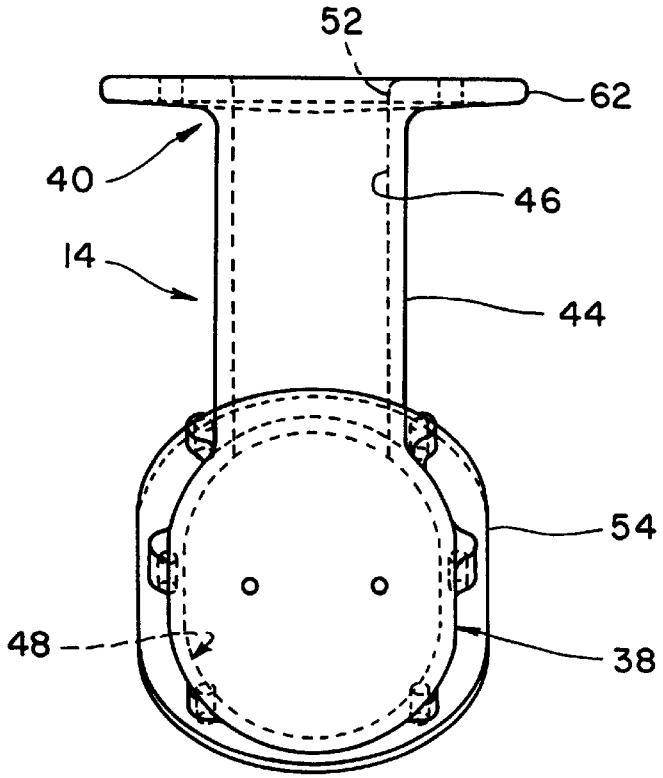
FIG. 7 is a right end elevational view of the reflector mounting arm illustrated in FIGS. 5 and 6 for the lighting fixture illustrated in FIGS. 1–4 in accordance with the present invention.

As seen in FIGS. 1 and 2 single-ended lamp 12 includes a metal base 30, a transparent glass bulb 32 extending outwardly from metal base 30 to a free end or tip 34, and an arc tube or filament 36 positioned within bulb 32. As can be seen, arc tube 36 is located along the longitudinal axis B of lamp 12 which in turn is substantially perpendicular to central aiming axis A of reflector 18. This arrangement of arc tube 36 is advantageous because arc tube 36 emits light in such a manner that a majority of the light output radiates radially from the longitudinal axis of arc tube 36 and a relatively small amount of light radiates directly from the ends of arc tube 36. Thus, lighting fixture 10 maximizes the amount of direct light radiating therefrom, while using a conventional single-ended lamp.

Preferably, base 30 is a screw-in type electrical connector which is threadedly mounted in lamp mounting socket 16. Of course, it will be apparent to those skilled in the art from this disclosure, that other types of bases with electrical connectors can be utilized for electrically connecting lamp 12 to the electrical contacts of lamp mounting socket 16.

Single-ended lamp 12 can be relatively heavy in large lighting fixtures, and thus, can exert a considerable amount of stress at the connection of the glass bulb 32 to the metal base 30. Accordingly, the tip or free end 34 of the glass bulb 32, which is preferably a substantially cylindrical tubular section, is supported by lamp end support 20 as discussed below.

As seen in FIGS. 1–4, lamp 12 extends transverse to the main or central aiming axis A of bowl-shaped reflector 18. In other words, longitudinal axis B of lamp 12 is substantially perpendicular to central aiming axis A of reflector 18. Since arc tube 36 is also positioned transverse to central aiming axis A, a large portion of the light from arc tube 36 radiates directly outwardly along the central aiming axis A of reflector 18. In contrast, most conventional lighting fixtures have their arc tubes aligned with the central aiming axis, and thus, the majority of the light radiating from such conventional lighting fixture is reflected light.

In its normal use, lamp 12 of lighting fixture 10 is maintained substantially horizontally by mounting arm 14 regardless of the angle of lighting fixture 10 as discussed below. More specifically, the arc tube or filament 36 of lamp 12 remains horizontal and located along the central aiming axis A of reflector 18 even when lighting fixture 10 is tilted. Accordingly, this avoids the "tilt factor" problem discussed above.

Reflector Mounting Arm 14

Referring now to FIGS. 3–8, reflector mounting arm 14 not only supports reflector 18, but also has lamp mounting socket 16 fixedly coupled thereto for transversely supporting lamp 12 within reflector 18 as mentioned above. More specifically, reflector mounting arm 14 has a first end 38 fixedly coupled to the side of bowl-shaped reflector 18 and a second end 40 coupled to a support member or ballast assembly 42 as seen in FIGS. 3 and 4. This arrangement of reflector mounting arm 14 maintains arc tube 36 of lamp 12 in the horizontal position even when lighting fixture 10 is tilted about the horizontal pivot axis of the joint 43 of ballast assembly 42.

Mounting arm 14 further includes a curved section 44 which extends between first end 38 and second end 40 such that curved section 44 lies in substantially the same plane as longitudinal axis B of lamp 12. In other words, curved section 44 closely follows the contour of the exterior surface of bowl-shaped reflector 18 such that first end 38 is located at the side of reflector 18, while second end 40 is located adjacent the center of reflector 18. A wiring channel 46 extends through curved section 44 between first and second ends 38 and 40 for housing wires 45, which electrically couples lamp mounting socket 16 to the ballast assembly 42 in a conventional manner.

More specifically, first end 38 of mounting arm 14 has a socket recess 48 with lamp mounting socket 16 fixedly secured therein. A first opening 50 is provided at first end 38 of mounting arm 14 for allowing base 30 of lamp 12 to pass therethrough for connection with socket 16. Second end 40 of mounting arm 14 has a second opening 52 formed at the other end of wiring channel 46 for receiving wires 45. Accordingly, wires 45 coming from support member or ballast assembly 42 extend through opening 52 of second end 40, and then pass through wiring channel 46 into socket recess 48, where wires 45 are electrically coupled to lamp mounting socket 16 in a conventional manner.

First end 38 of mounting arm 14 further includes a first annular mounting flange 54 surrounding first opening 50 for fixedly coupling first end 38 of mounting arm 14 to the side of reflector 18. In particular, a plurality of threaded bores 56 are formed in mounting flange 54 for threadedly receiving threaded fasteners 58 therein to secure bowl-shaped reflector 18 thereto as seen in FIGS. 1 and 3.

Second end 40 of mounting arm 14 has a second annular mounting flange 62 surrounding second opening 52 for attaching mounting arm 14 to support member or ballast assembly 42. In particular, second mounting flange 62 has four mounting holes 64 for receiving threaded fasteners 66 to removably secure lighting fixture 10 to ballast assembly 42 via mounting arm 14.

Mounting gaskets (not shown) are preferably positioned between the interfaces of first mounting flange 54 and the exterior of reflector 18 as well as second mounting flange 62 and ballast assembly 42 to prevent water from seeping therebetween. The mounting gaskets are preferably conventional rubber gaskets, and thus, they will not be discussed or illustrated in detail herein.

Preferably, mounting arm 14 is constructed as a one-piece, unitary member from cast aluminum or any other suitable material. Moreover, mounting arm 14 preferably has a polyester powder, painted finish thereon. For example, mounting arm 14 can be painted with LEKTROCOTE® paint.

As seen in FIG. 4, ballast assembly 42 is a conventional ballast assembly which includes a pivotal support member, for tilting lighting fixture 10 to the desired position. Since ballast assemblies such as ballast assembly 42 are well known in the art, ballast assembly 42 will not be discussed or illustrated in detail herein. Of course, it will be apparent to those skilled in the art that mounting arm 14 can be fixedly coupled to a variety of support members which are known in the art. In other words, the support member can be mounted to either a fixed support or a movable support, with or without a ballast directly coupled thereto.

As seen in FIGS. 1 and 4, lamp mounting socket 16 is preferably a conventional lamp socket with electrical contacts (not shown), which are electrically coupled to wires 45 in a conventional manner. Lamp mounting socket 16 is also electrically coupled metal base 30 of lamp 12 in a conventional manner. For example, lamp mounting socket 16 can be a spring loaded mogul base with a lamp grip screw shell for threadedly mounting metal base 30 of lamp 12 therein in a conventional manner. Of course, it will be apparent to those skilled in the art that other types of electrical mounting arrangements can be used if needed and/or desired.

As seen in FIGS. 3 and 4, lamp mounting socket 16 is axially mounted within socket recess 48 by a pair of threaded fasteners 72 such that lamp mounting socket 16 is fixedly coupled to mounting arm 14 within socket recess 48. Of course, it will be apparent to those skilled in the art that lamp mounting socket 16 can be secured within socket recess 48 of mounting arm 14 in other ways.

Bowl-shaped Reflector 18

Bowl-shaped reflector 18 is preferably a metal reflector having a hemispherical or parabolic reflective interior surface 80 which is arranged about main or central aiming axis A for reflecting light emitted from lamp 12 outwardly from lighting fixture 10. Reflector 18 is preferably constructed as a one-piece member such as a spun aluminum. Interior surface 80 has a reflective or specular finish such as ALUMINUM ANODAL®.

As seen in FIGS. 3 and 4, a substantially circular lens mounting flange 82 is formed at the peripheral edge of interior surface 80. Lens mounting flange 82 defines the open front 84 of reflector 18 from which light is emitted. Open front 84 is substantially circular with its center located on the main or central aiming axis A of reflector 18.

As seen in FIG. 1, lens mounting flange 82 hingedly supports a lens cover 86 in a conventional manner. Basically, lens cover 86 is attached to lens mounting flange 82 by a hinge 88 and four spring clips or latches 90 as seen in FIGS. 1–4. More specifically, lens cover 86 includes a lens ring 92 surrounding a glass lens 94. The lens ring 92 is pivotally coupled to lens mounting flange 82 by hinge 88 and four latches 90. Preferably, lens ring 92, hinge 88 and latches 90 are all constructed of stainless steel. Lens 94 is preferably a thermal shock, impact resistant, clear, tempered glass lens which is sealed to the reflector by a high temperature silicone gasket (not shown). Since lens covers, such as lens cover 86, are well known in the art, lens cover 86 will not be discussed or illustrated in detail herein.

As best seen in FIGS. 1 and 3, bowl-shaped reflector 18 also has a side lamp socket opening 96 with a plurality of mounting holes 98 positioned thereround for receiving fasteners 58 to secure mounting arm 14 thereto. More specifically, first opening 50 of mounting arm 14 is arranged to coincide with mounting opening 96 of bowl-shaped reflector 18 so that lamp 14 extends outwardly from lamp mounting socket 16 and through openings 52 and 96 into reflector 18. This allows lamp 12 to be mounted substantially transverse to the main or central aiming axis A of reflector 18.

Lamp End Support 20

Figure 9:
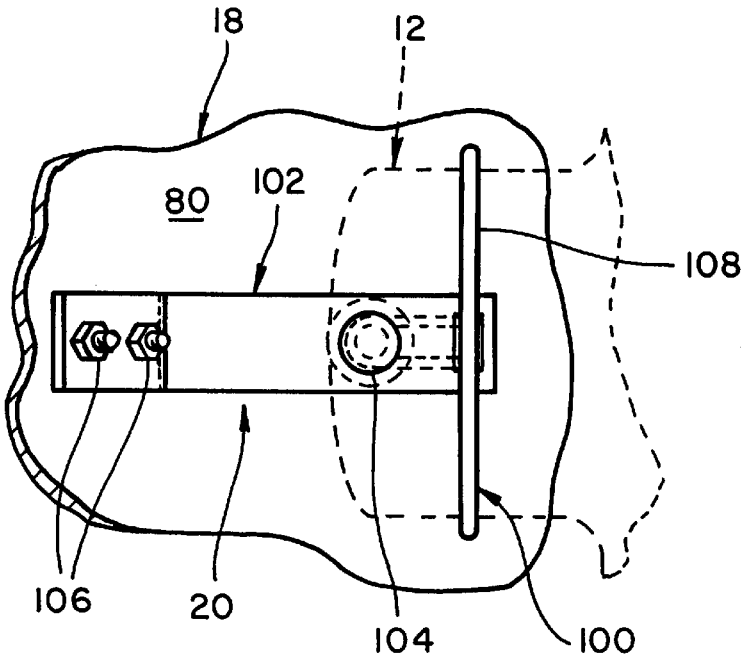
FIG. 9 is a front elevational view of the lamp end support for the lighting fixture illustrated in FIGS. 1–4 in accordance with the present invention, with the free end of the lamp shown in broken lines and the bowl-shaped reflector shown in partial front elevation.
Figure 10:
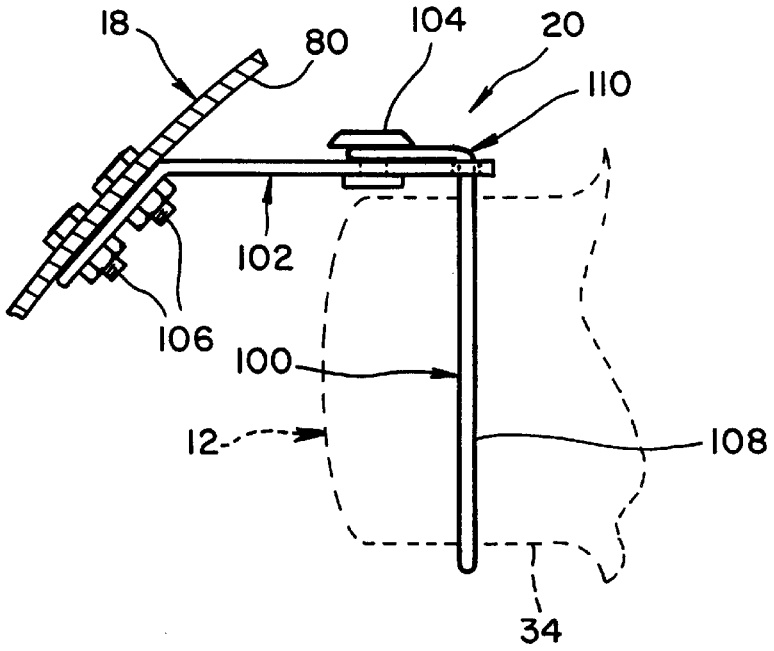
FIG. 10 is a top plan view of the lamp end support illustrated in FIG. 9 with the free end of the lamp shown in broken lines and the bowl-shaped reflector shown in partial cross-section.
Figure 11:
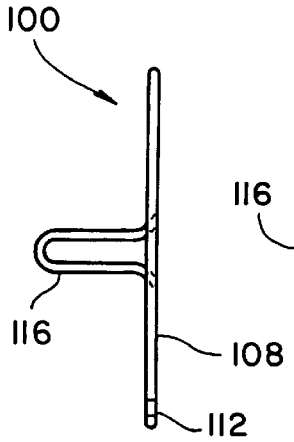
FIG. 11 is a front elevational view of the wire clip member of the lamp end support illustrated in FIGS. 9 and 10.
Figure 12:
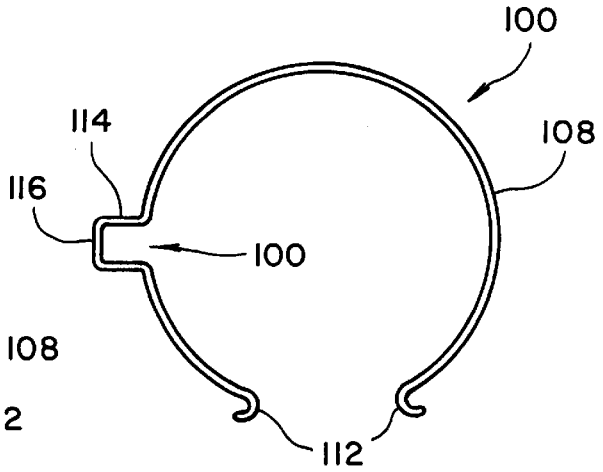
FIG. 12 is a left end elevational view of the wire clip member illustrated in FIGS. 9–11.
Figure 13:
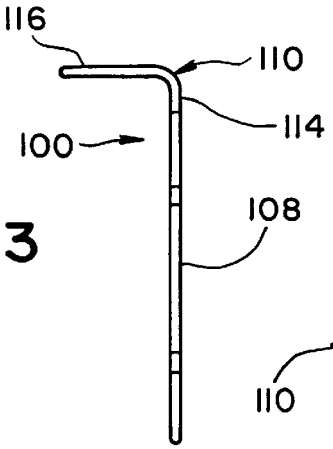
FIG. 13 is a top plan view of the wire clip member illustrated in FIGS. 9–12.
Figure 14:
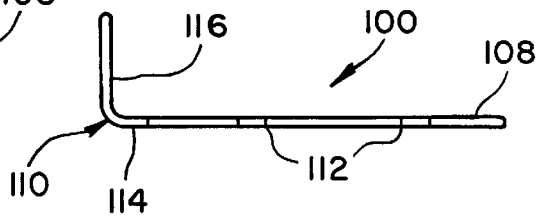
FIG. 14 is a bottom plan view of the wire clip member illustrated in FIGS. 9–13.

Referring now to FIGS. 9 and 10, lamp end support 20 is illustrated as being fixedly coupled to interior surface 80 of bowl-shaped reflector 18. As seen in FIGS. 1, 3 and 4, lamp end support 20 is positioned across from socket opening 96 of reflector 18 for supporting free end or tip 34 of lamp 12. Lamp end support 20 relieves some of the stresses occurring in glass bulb 32 at its connection to metal base 30 due to gravity applying a downwardly extending force thereto. In other words, single-ended lamp 12 would normally only be supported by its base 30, which is mounted in lamp mounting socket 16.

This arrangement results in stress occurring in the bulb 32 which in turn can result in lamp 12 breaking and/or downward sagging or drooping of lamp. If lamp 12 sags or droops, this can cause defocusing of lamp 12. In particular, arc tube of filament 36 will no longer be in the optimal position within bowl-shaped reflector 18 relative to glare and spill assembly 22 and interior surface 80 of reflector 18. Thus, failure to relieve this stress can result in performance degradation of lighting fixture 10. Lamp end support 20 is designed relieve this stress in bulb 32. In particular, lamp 12 in the present invention is supported at both ends, i.e., lamp 12 is supported at one end by lamp mounting socket 16 and at its other end by lamp end support 20.

Lamp end support 20 preferably includes a wire clip member 100, a support bracket 102 fixedly coupled to wire clip member 100 via a fastener 104, and a pair of threaded fasteners 106 for fixedly coupling lamp end support 20 to reflector 18. Wire clip member 100 is designed to releasably engage the free end or tip 34 of lamp 12 via a snap fit, while support bracket 102 is designed to be fixedly coupled to interior surface 80 of bowl-shaped reflector 18 via threaded fasteners 108.

As seen in FIGS. 11–14, wire clip member 100 is formed by bending a single wire into a C-shaped clip portion 108 for engaging free end or tip 34 of lamp 12, and a connecting portion 110 for connecting clip portion 108 to support bracket 102 via fastener 104. The free ends 112 of the wire are curved and spaced apart from each other to form an opening such that the tip or free end 34 of lamp 12 can be inserted into C-shaped clip portion 108. Clip portion 108 is sufficiently resilient such that it can be flexed to receive tip 34 of lamp 12 therein. Furthermore, C-shaped clip portion 108 is resilient and sized slightly smaller than the diameter of tip 34 of lamp 12 to apply a slight pressure on tip 34 for supporting lamp 12.

Connecting portion 110 of wire clip member 100 is substantially L-shaped in plan view and has a first section 114 lying in the same plane as clip portion 108 and a second section 116 which is angled relative to first section 114. More specifically, second section 116 extends substantially perpendicular to first section 114 and is coupled to bracket 102 by fastener 104. Basically, the portion of the wire forming connecting portion 110 is bent to form an L-shaped loop for receiving fastener 104 along first section 114 to couple wire clip member 100 to bracket 102 as discussed below.

Figure 8:
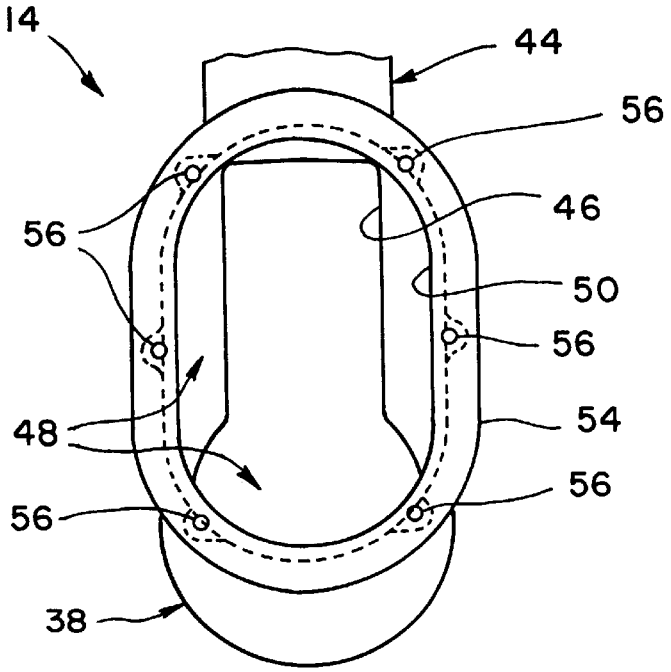
FIG. 8 is a partial auxiliary elevational view of the reflector mounting arm illustrated in FIGS. 5–7 as seen along the longitudinal axis of the opening of the first end of the reflector mounting arm.
Figure 15:
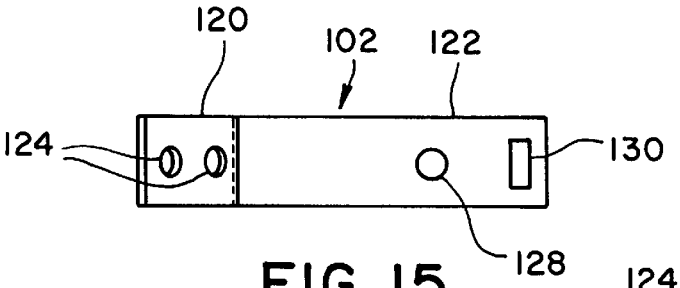
FIG. 15 is a front elevational view of the mounting bracket for the lamp end support illustrated in FIGS. 9 and 10.
Figure 17:
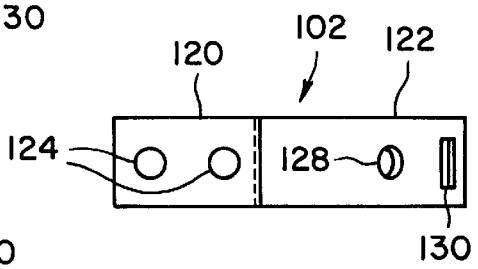
FIG. 17 is a rear auxiliary elevational view of the mounting bracket illustrated in FIGS. 15 and 16 for the lamp end support illustrated in FIGS. 9 and 10 as seen substantially perpendicular to the first end of the bracket.
Figure 16:
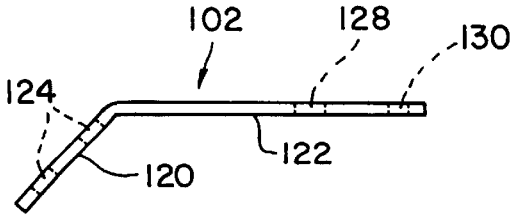
FIG. 16 is a top plan view of the mounting bracket illustrated in FIG. 15 for the lamp end support illustrated in FIGS. 9 and 10.

Referring now to FIGS. 15–17, support bracket 102 is illustrated, and includes a first planar section or end 120 for connecting to interior surface 80 of reflector 18, and a second section or end 122 extending from first section 120 at an angle of approximately 135° for coupling to connecting portion 110 of wire clip member 100 thereto. First section 120 of bracket 102 has a pair of fastener holes 124 for receiving fasteners 106 therethrough for connecting support bracket 102 to the interior surface 80 of reflector 18 as seen in FIGS. 8 and 9.

Preferably, fasteners 106 are either a nut and bolt arrangement as shown for removably coupled lamp end support 20 to reflector 18, or rivets for permanently mounting lamp end support 20 to reflector 18. Of course, it will be apparent to those skilled in the art from this disclosure that other types of fastening means can be utilized, including spot welding, sheet metal screws, etc.

Referring again to FIGS. 15–17, second section 122 of bracket 102 extends outwardly from first section 120, preferably at an angle of about 135°, so as to extend substantially parallel to the longitudinal axis B of lamp 12. In other words, second section 122 extends substantially perpendicular to the main or central aiming axis A of reflector 18. Second section 122 of bracket 102 preferably has a fastener opening 128 for receiving fastener 104 therethrough to secure C-shaped wire clip member 100 to support bracket 102.

Moreover, second section 122 of bracket 102 has a rectangular slot 130 for receiving first section 114 of connecting portion 110 of wire clip member 100 therethrough. More specifically, as seen in FIGS. 8 and 9, first section 114 of connecting portion 110 passes through slot 130 of bracket 102, while second section 116 of connecting portion 110 of wire clip member 100 extends along the backside of second section 122 of support bracket 102 for being secured thereto via fastener 104. Accordingly, second section 122 of support bracket 102 holds the clip portion 108 of wire clip member 100 substantially perpendicular thereto. Clip portion 108 of wire clip member 100 is also arranged substantially perpendicular to the longitudinal axis B of lamp 12 such that the free end 34 of lamp 12 is received and supported within clip portion 108.

Fastener 104 is preferably a rivet for permanently securing C-shaped wire clip member 100 to support bracket 102. Of course, it will be apparent to those skilled in the art that other types of fasteners known in the art can be used to either removably or fixedly couple wire clip member 100 to support bracket 102.

Glare and Spill Control Assembly 22 Referring now to FIGS. 1 and 18–31, glare and spill control assembly 22 is designed for aiming and controlling the light emitted from lamp 12, whether emitted directly or indirectly via bowl-shaped reflector 18. Glare and spill control assembly 22 has an upper louver assembly 140 fixedly coupled to interior surface 80 of bowl-shaped reflector 18, and a reflector insert assembly 142 also fixedly coupled to interior surface 80 of bowl-shaped reflector 18. More specifically, upper louver assembly 140 is generally located in the upper hemisphere of bowl-shaped reflector 18, while reflector insert assembly 142 is located in the lower hemisphere of bowl-shaped reflector 18.

Figure 18:
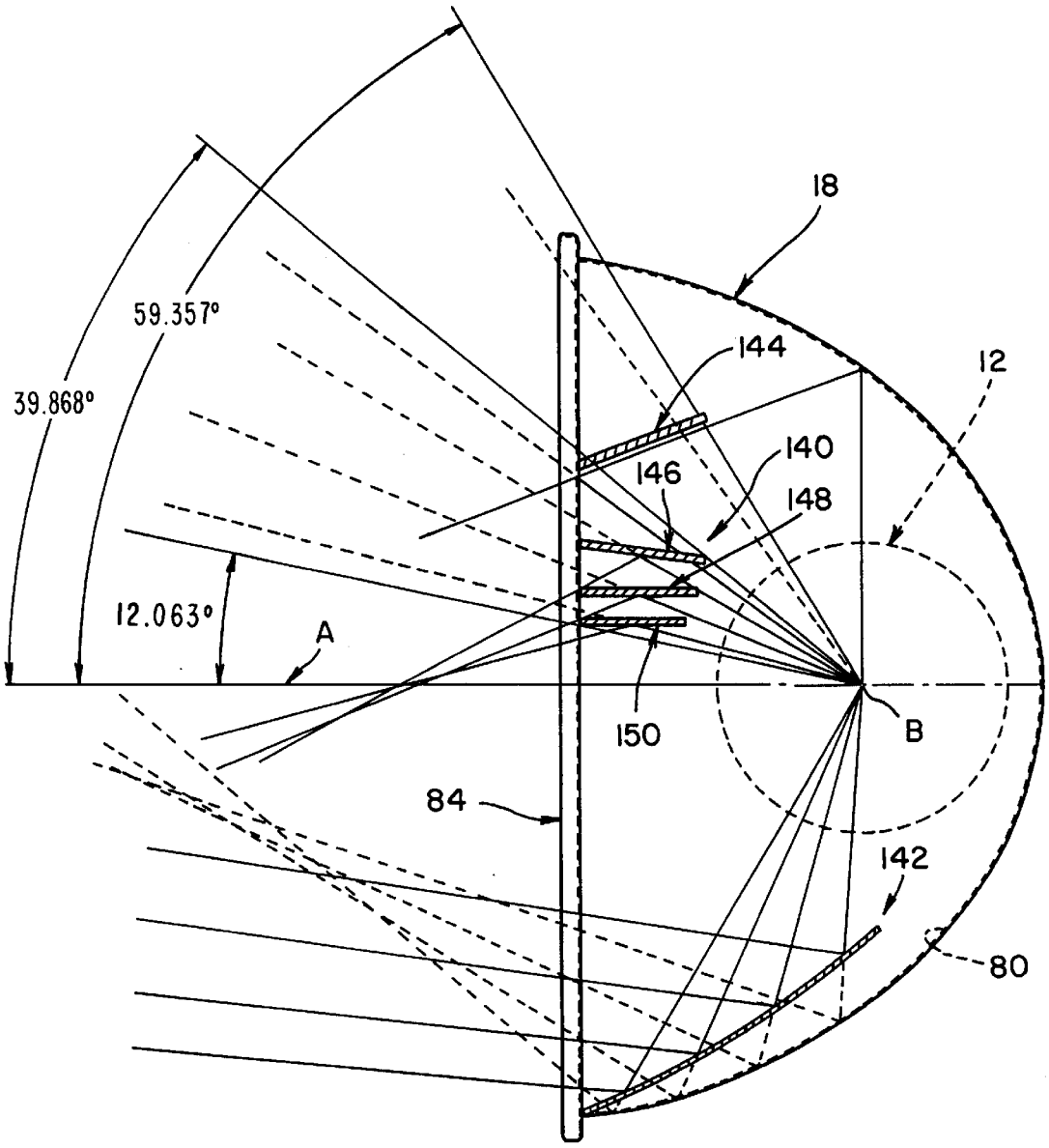
FIG. 18 is a side diagrammatical elevational view of the glare and spill control assembly mounted within the bowl-shaped reflector of the lighting fixture illustrated in FIGS. 1–4.

As seen in FIG. 18, the diagrammatical representation of lighting fixture 10 and glare and spill control assembly 22 illustrates the light rays being emitted from lamp 12 as well as how the lights rays are reflected by reflector 18 and redirected and/or blocked by glare and spill control assembly 22. More specifically, FIG. 18 illustrates that upper louver assembly 140 blocks the light rays of lamp 12 from being radiated into the glare zone and redirects a portion of the light rays, which would otherwise be radiated into the glare zone, back into the main light beam.

Accordingly, upper louver assembly 140 is designed to prevent light rays from traveling upwardly and outwardly which produces most of the glare from lighting fixture 10. More specifically, upper louver assembly 140 blocks the light rays which would normally escape into the glare zone, but for upper louver assembly 140, and/or redirects such light rays downwardly towards and across the main aiming axis A. Thus, upper louver assembly 140 controls light emitted directly from lamp 12 from traveling upwardly and outwardly from lighting fixture 10. Of course, some of the reflected light may also be blocked by upper louver assembly 140, however, as explained below, the amount of reflected light which is blocked by upper louver assembly 140 is minimized due to the angle and positioning of upper louver assembly 140.

Reflector insert assembly 142, on the other hand, mainly redirects the light rays which would normally be reflected upwardly by the lower half or hemisphere of bowl-shaped reflector 18. In particular, reflector insert assembly 142, as explained below in more detail, is designed to redirect the reflected rays along the lower hemisphere of reflector 18 such that the light rays are redirected more parallel to the main or central aiming axis A reflector 18. If reflector insert assembly 142 was not attached to reflector 18, some of the light rays reflecting off the lower hemisphere of reflector 18 would normally extend across the main or central aiming axis A of reflector 18 closer to the front of lighting fixture 10 such that some of the light rays would escape into the glare zone.

Upper Louver Assembly 140 Upper louver assembly 140, as best seen in FIGS. 1 and 2, includes an outermost arc-shaped louver or baffle 144, an upper middle arc-shaped louver 146, a lower middle arc-shaped louver 148 and a center arc-shaped louver 150. Arc-shaped louvers 144, 146, 148 and 150 are preferably concentrically arranged about the main or central aiming axis A of reflector 18. Arc-shaped louvers 144, 146, 148 and 150 are fixedly connected to interior surface 80 of bowl-shaped reflector 18 via a vertical louver support 152 and a pair of horizontal louver supports 154 and 156.

Preferably, arc-shaped louvers 144, 146, 148 and 150 and supports 152, 154 and 156 are all constructed from a thin metallic sheet metal material. One such suitable sheet material is sheet aluminum. Preferably, the sheet materials used to form louvers 144, 146, 148 and 150 are approximately 0.020 inch in thickness, while the sheet materials used to form each of the supports 152, 154 and 156 is about 0.040 inch in thickness.

Outermost arc-shaped louver 144 is preferably a two-piece construction having a first arc-shaped member 160 and a second substantially identical arc-shaped member 162 which is the mirror image of first arc-shaped member 160. Each of the arc-shaped members 160 and 162 has four planar reflector segments 164 and a pair of mounting tabs 166 and 168 extending from their ends for coupling arc-shaped members 160 and 162 to louver supports 152, 154 and 156.

Figure 19:
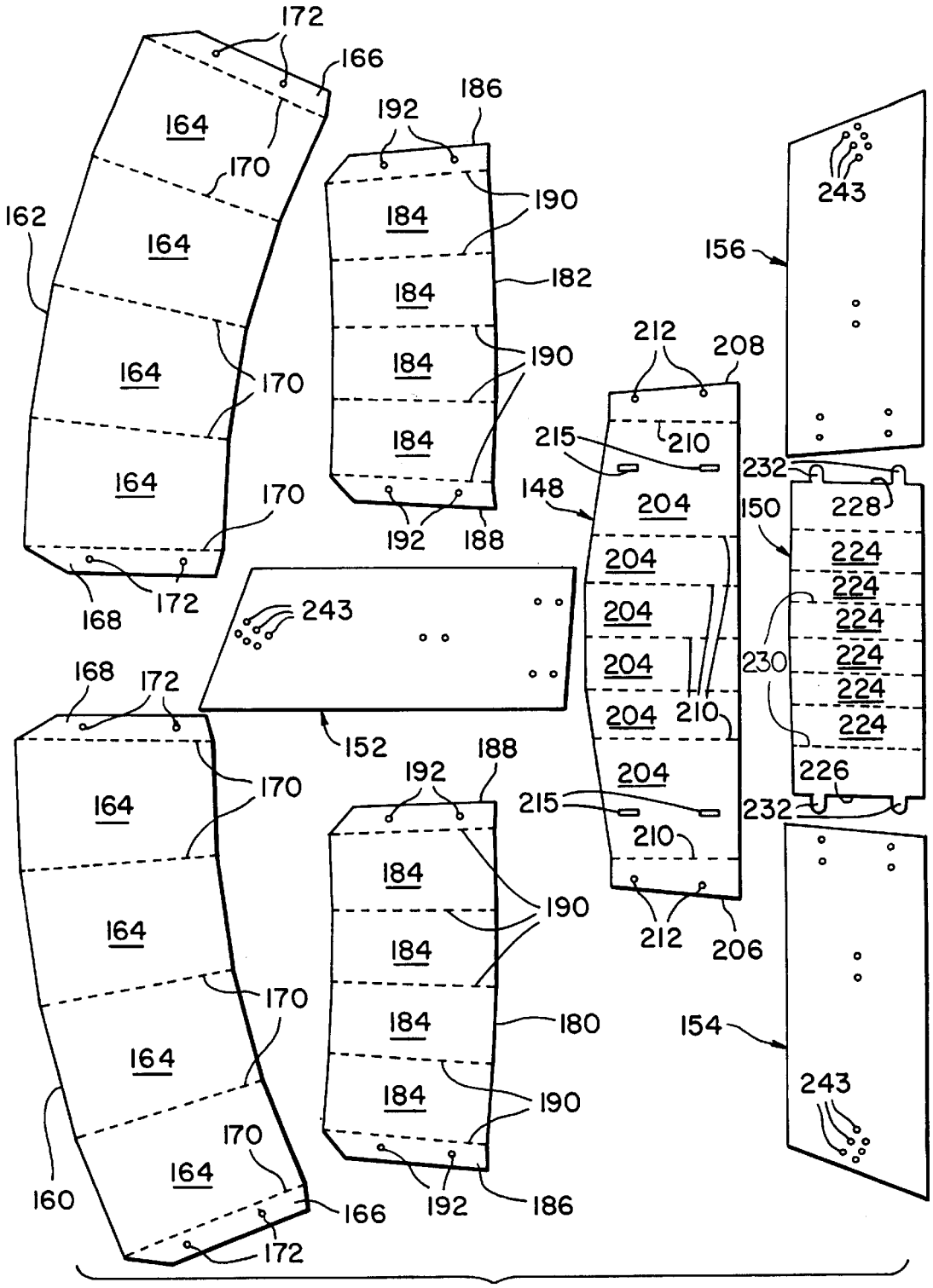
FIG. 19 is an exploded plan view of the upper louver assembly prior to being bent and assembled within the bowl-shaped reflector of the lighting fixture illustrated in FIGS. 1–4.

More specifically, as seen in FIG. 19, planar segments 164 of arc-shaped louver 144 are substantially trapezoidal in shape with their angled sides coupled to the adjacent planar segment or one of the mounting tabs 166 or 168. In other words, each of the first and second arc-shaped members 160 and 162 are bent along fold lines 170 to form an angled arc-shaped member with the four planar segments 164 and mounting tabs 166 and 168.

Each of the mounting tabs 166 and 168 has a pair of holes 172 for receiving fasteners 174 to fixedly secure first and second members 160 and 162 of outermost arc-shaped louver 144 to supports 152, 154 and 156. Preferably, fasteners 174 are rivets which fixedly and permanently secure arc-shaped members 160 and 162 to supports 152, 154 and 156. However, it will be apparent to those skilled in the art that other types of fastening means can be utilized, including nuts and bolts, screws and/or welds to interconnect first and second members 160 and 162 to supports 152, 154 and 156.

As seen in FIG. 1, mounting tabs 166 of first and second arc-shaped members 160 and 162 are fixedly coupled to horizontal supports 154 and 156, respectively, via fasteners 174. Mounting tabs 168 of first and second arc-shaped members 160 and 162, on the other hand, are each fixedly secured to vertical support 152 by fasteners 174.

Figure 20:
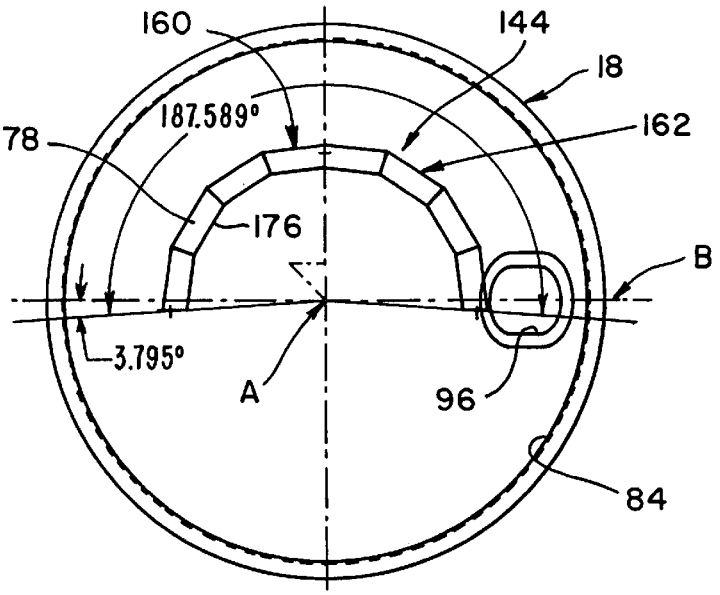
FIG. 20 is a front diagrammatical elevational view of the first or outermost arc-shaped louver mounted within the bowl-shaped reflector of the lighting fixture illustrated in FIGS. 1–4.
Figure 21:
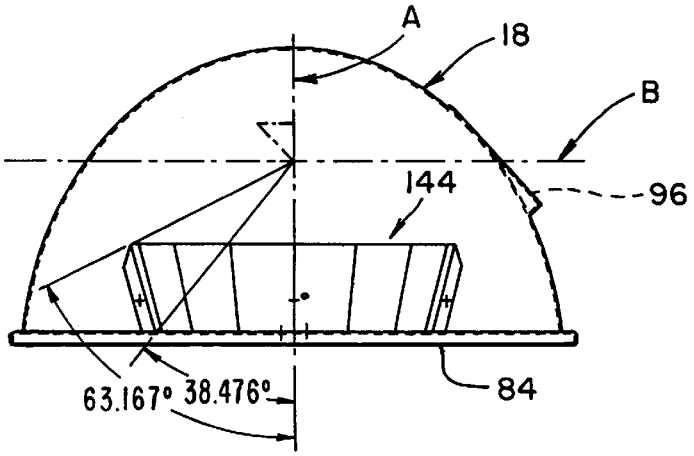
FIG. 21 is a top diagrammatical plan view of the outermost arc-shaped louver mounted within the bowl-shaped reflector of the lighting fixture illustrated in FIGS. 1–4.
Figure 22:
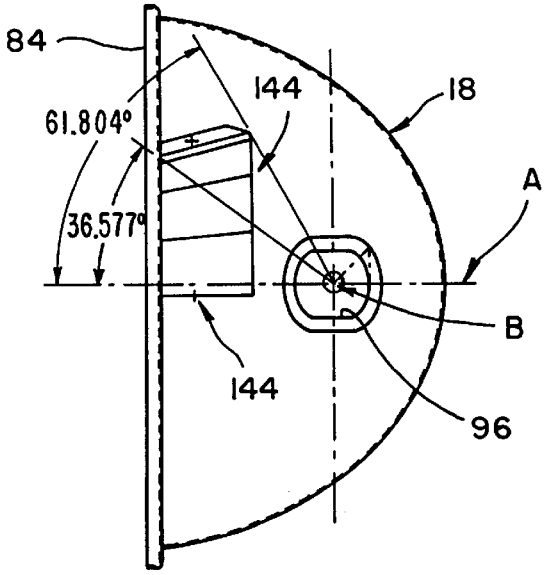
FIG. 22 is a side diagrammatical elevational view of the outermost arc-shaped louver mounted within the bowl-shaped reflector of the lighting fixture illustrated in FIGS. 1–4.
Figure 23:
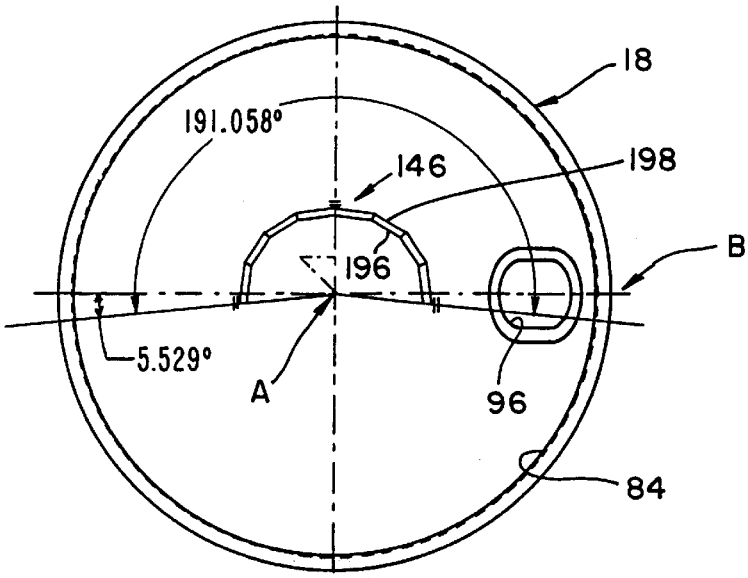
FIG. 23 is a front diagrammatical elevational view of the second or upper middle arc-shaped louver mounted within the bowl-shaped reflector of the lighting fixture illustrated in FIGS. 1–4.
Figure 24:
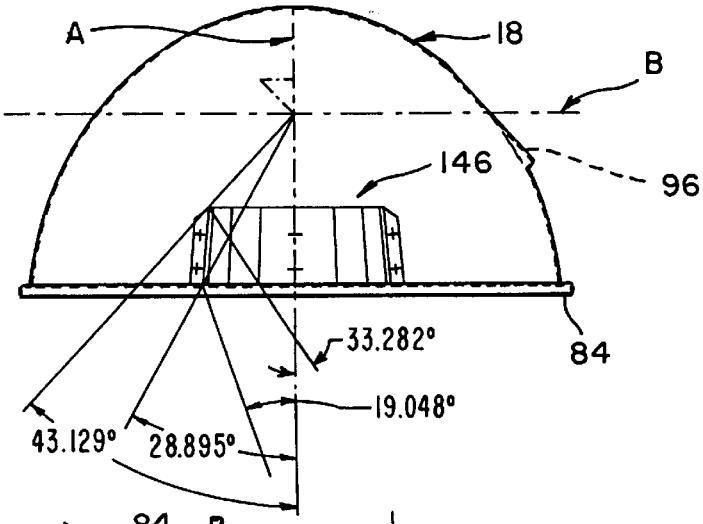
FIG. 24 is a top diagrammatical plan view of the upper middle arc-shaped louver mounted within the bowl-shaped reflector of the lighting fixture illustrated in FIGS. 1–4.
Figure 25:
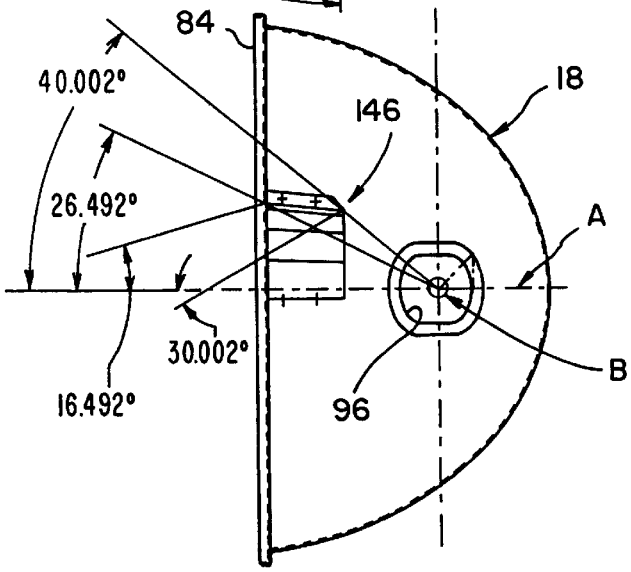
FIG. 25 is a side diagrammatical elevational view of the upper middle arc-shaped louver mounted within the bowl-shaped reflector of the lighting fixture illustrated in FIGS. 1–4.

When outermost arc-shaped louver 144 is connected to supports 152, 154 and 156, outermost arc-shaped louver 144 extends approximately 187.589° about main or central aiming axis A of reflector 18 as seen in FIG. 20. As seen in FIGS. 1 and 2, outermost arc-shaped louver 144 has an inner surface 176 facing radially inwardly towards central aiming axis A of reflector 18, and an outer surface 178 facing radially outwardly from central aiming axis A of reflector 18. Preferably, outermost arc-shaped louver 144 is angled radially inwardly towards central aiming axis A as inner and outer surfaces 176 and 178 approach open front 84 of reflector 18. In other words, outermost arc-shaped louver 144 is angled radially inwardly as inner and outer surfaces 176 and 178 extend away from interior surface 80 of reflector 18 towards open front 84 of reflector 18.

Inner surface 176 has a non-specular finish, which preferably has a light absorbing finish thereon. For example, inner surface 176 can be painted black with a high temperature paint. Accordingly, inner surface 176 of outermost arc-shaped louver 144 is designed to block light emitted by lamp 12 from radiating outwardly into the glare zone.

Outer surface 178, on the other hand, is a plain non-specular surface which does not significantly effect the light rays from lamp 12. In particular, each of the planar segments 164 of outermost arc-shaped louver 144 is preferably angled relative to reflector 18 such that the light rays reflected from reflector 18 pass substantially parallel to planar segments 164. In other words, the reflected light rays from reflector 18 which pass adjacent to inner or outer surfaces 176 and 178 are substantially parallel to inner and outer surfaces 176 and 178 such that outermost arc-shaped louver 144 does not substantially obstruct the reflected light rays from reflector 18. Rather, only the light rays which are directly emitted from lamp 12 are blocked or absorbed by inner surface 176 of planar segments 164.

Upper arc-shaped middle louver 146 is also a two-piece construction having a first arc-shaped member 180 and a second arc-shaped member 182 which is substantially identical to first member 180 but the mirror image thereof. Each of the first and second arc-shaped members 180 and 182 has four planar reflector segments 184 and a pair of mounting tabs 186 and 188.

As seen in FIG. 19, planar segments 184 are preferably trapezoidal-shaped with their angles sides connected to adjacent planar segments 184 and/or two tabs 186 or 188 via fold lines 190. In other words, planar segments 184 and tabs 186 and 188 are formed by bending the metal sheet forming first and second arc-shaped members 180 and 182, as seen in FIG. 19, into a pair of substantially arc-shaped members with outwardly extending mounting tabs 186 and 188, as seen in FIG. 1.

Each of the mounting tabs 186 and 188 has a pair of fastener holes 192 for receiving fasteners 194 to fixedly couple upper middle arc-shaped louver 146 to supports 152, 154 and 156. Preferably, fasteners 194 are rivets which fixedly and permanently secure arc-shaped members 180 and 182 to supports 152, 154 and 156. However, it will be apparent to those skilled in the art that other types of fastening means such as spot welding, screws, bolts and nuts, etc., can be used instead of rivets.

As seen in FIG. 1, mounting tabs 186 of first and second arc-shaped members 180 and 182 are fixedly coupled to horizontal supports 154 and 156, respectively by fasteners 194. Mounting tabs 188 of first and second arc-shaped members 180 and 182, on the other hand, are each fixedly secured to vertical support 152 by fasteners 194.

As seen in FIGS. 1 and 2, upper middle arc-shaped louver 146 has an inner surface 196 facing radially inwardly towards center aiming axis A of reflector 18, and an outer surface 198 facing radially outwardly from central aiming axis A of reflector 18. Preferably, inner surface 196 is a reflective surface with a specular finish for redirecting the light rays, which are directly emitted from lamp 12, back downwardly towards and across the central aiming axis A. These redirected light rays which are reflected downwardly by upper middle arc-shaped louver 146 would normally escape into the glare zone but for upper middle arc-shaped louver 146. Accordingly, upper middle arc-shaped louver 146 redirects light rays which would otherwise be lost into the glare zone downwardly back into the main beam of light. Outer surface 198, on the other hand, preferably has a light absorbing finish so that substantially no light is reflected by outer surface 198.

In contrast to outermost arc-shaped louver 144, upper middle arc-shaped louver 146 is angled to diverge away from central aiming axis A of reflector 18 as it approaches open front 84. More specifically, each of the planar segments 194 of upper middle arc-shaped louver 146 is angled relative to central aiming axis A such that as inner and outer surfaces 196 and 198 of planar segments 194 approach open front 84 of reflector 18 as they diverge away from central aiming axis A. In other words, planar segments 194 are directed radially downwardly to converge towards central aiming axis A as they approach towards the rear of reflector 18.

As seen in FIG. 1, lower middle arc-shaped louver 148 is preferably constructed as a one-piece, unitary member from a single sheet of material, which is bent to form six planar reflector segments 204 and a pair of mounting tabs 206 and 208. More specifically, as seen in FIG. 19, the sheet material forming lower middle arc-shaped louver 148 is bent along fold lines 210 such that the six planar segments 204 form an angled arc-shaped member with mounting tabs 206 and 208 extending radially outwardly from the ends of lower middle arc-shaped louver 148. In other words, planar segments 204 are angled relative to each other to form an arc, which is arranged about central aiming axis A.

As seen in FIGS. 1 and 19, each of the mounting tabs 206 and 208 has a pair of mounting holes 212 for receiving fasteners 214 to fixedly secure lower middle arc-shaped louver 148 horizontal supports 154 and 156. Preferably, fasteners 214 are rivets which fixedly and permanently secure arc-shaped louver 148 to horizontal supports 154 and 156. However, it will be apparent to those skilled in the art that other types of fastening means can be utilized, including bolts, screws and/or welds to interconnect lower middle arc shaped louver 148 to horizontal supports 154 and 156.

Each of the two end planar segments 204 of lower middle arc-shaped louver 148 also includes a pair of coupling slots 215 for attaching and supporting center arc-shaped louver 150 thereto, as explained below.

Figure 26:
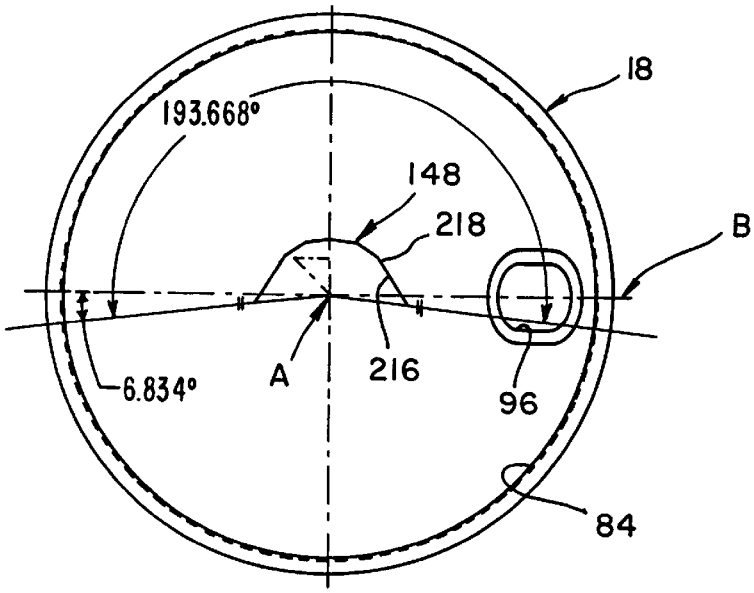
FIG. 26 is a front diagrammatical elevational view of the third or lower middle arc-shaped louver mounted within the bowl-shaped reflector of the lighting fixture illustrated in FIGS. 1–4.
Figure 27:
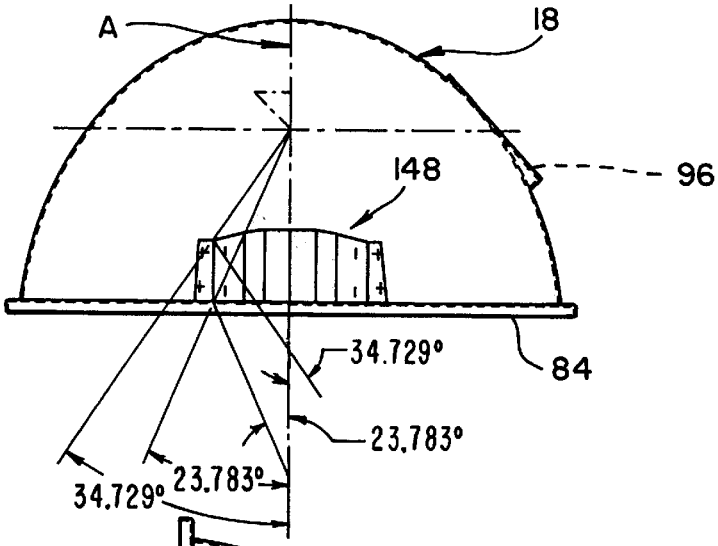
FIG. 27 is a top diagrammatical plan view of the lower middle arc-shaped louver mounted within the bowl-shaped reflector of the lighting fixture illustrated in FIGS. 1–4.
Figure 28:
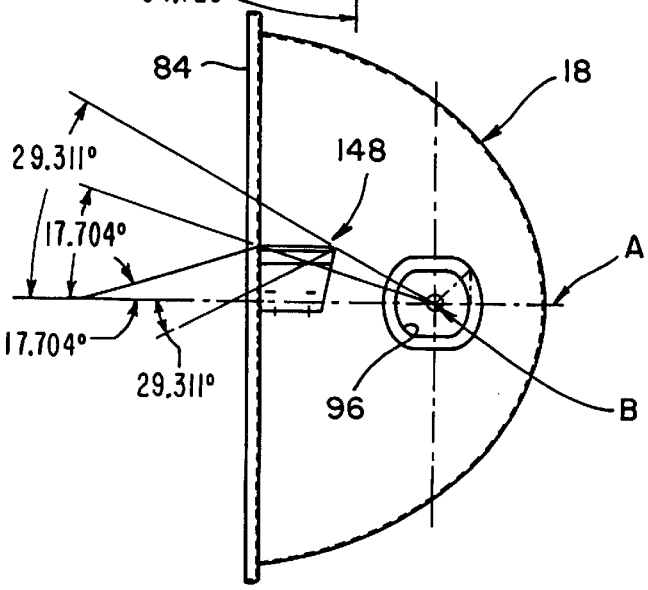
FIG. 28 is a side diagrammatical elevational view of the lower middle arc-shaped louver mounted within the bowl-shaped reflector of the lighting fixture illustrated in FIGS. 1–4.

When lower middle arc-shaped louver 148 is connected to horizontal supports 154 and 156, lower middle arc-shaped louver 148 extends approximately 193.668° about main or central aiming axis A of reflector 18 as illustrated in FIG. 26.

As seen in FIGS. 1 and 2, lower middle arc-shaped louver 148 has an inner surface 216 facing radially inwardly towards central aiming axis A of reflector 18 and an outer surface 218 facing radially outwardly from central aiming axis A of reflector 18. Preferably, lower middle arc-shaped louver 148 is arranged such that its planar segments 204 extends substantially parallel to the central aiming axis A of reflector 18 as inner and outer surfaces 216 and 218 extend between open front 84 of reflector 18 and the rear of reflector 18.

Inner surface 216 has a specular finish which is designed to redirect light rays from lamp 12 downwardly back into the main beam that would otherwise normally escape into the glare zone. Outer surface 218, on the other hand, has preferably a light absorbing finish so that substantially no light is reflected by outer surface 218. For example, outer surface 218 can be painted with a high temperature black paint.

Referring now to center arc-shaped louver 150, as seen in FIGS. 19 and 29–31, center arc-shaped louver 150 is preferably constructed as a one-piece, unitary member from a single sheet of material, which is bent to form six planar reflector segments 224 and a pair of mounting tabs 226 and 228. More specifically, as seen in FIGS. 19, the sheet material forming center arc-shaped louver 150 is bent along fold lines 230 such that the six planar segments 224 form an angled arc-shaped member with mounting tabs 226 and 228 extending radially outwardly from the ends of center arc shaped louver 150. In other words, planar segments 224 are angled relative to each other to form an arc, which is arranged about central aiming axis A of reflector 18.

As seen in FIGS. 1 and 2, each of the mounting tabs 226 and 228 has a pair of coupling flanges 232, which are inserted into coupling slots 215 of lower middle arc-shaped louver 148 and the bent to fixedly secure center arc-shaped louver 150 to lower middle arc-shaped louver 148.

Figure 29:
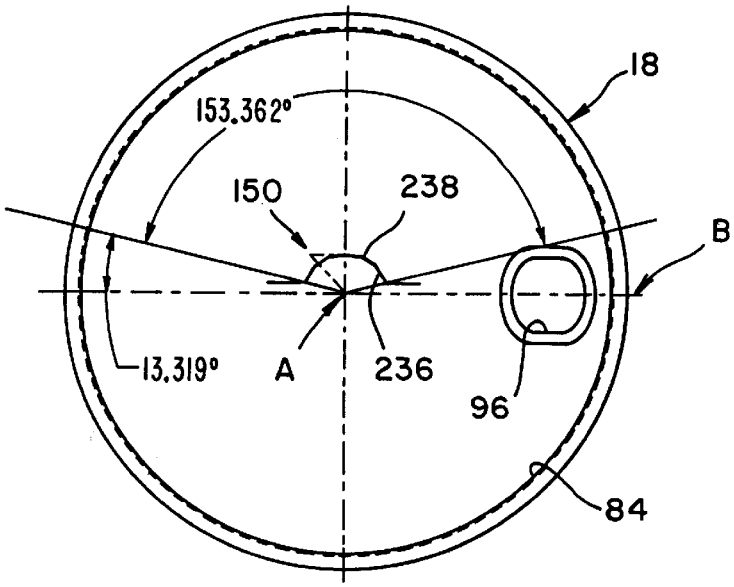
FIG. 29 is a front diagrammatical elevational view of the fourth or center arc-shaped louver mounted within the bowl-shaped reflector of the lighting fixture illustrated in FIGS. 1–4.
Figure 30:
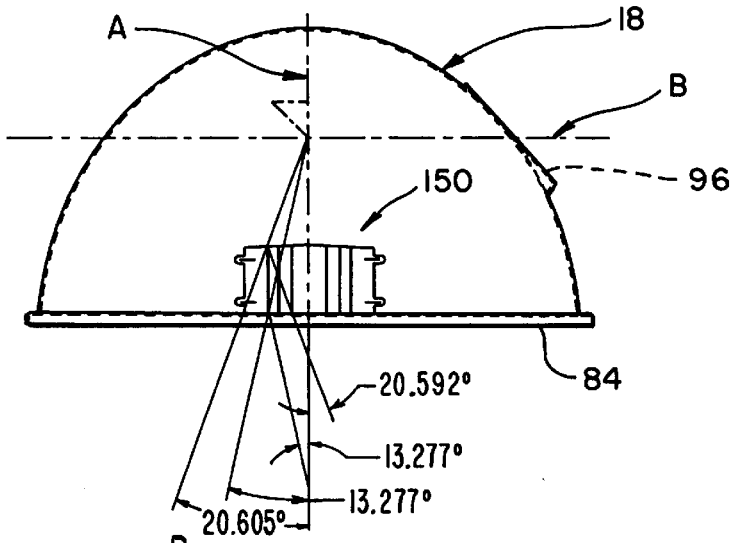
FIG. 30 is a top diagrammatical plan view of the center arc-shaped louver mounted within the bowl-shaped reflector of the lighting fixture illustrated in FIGS. 1–4.
Figure 31:
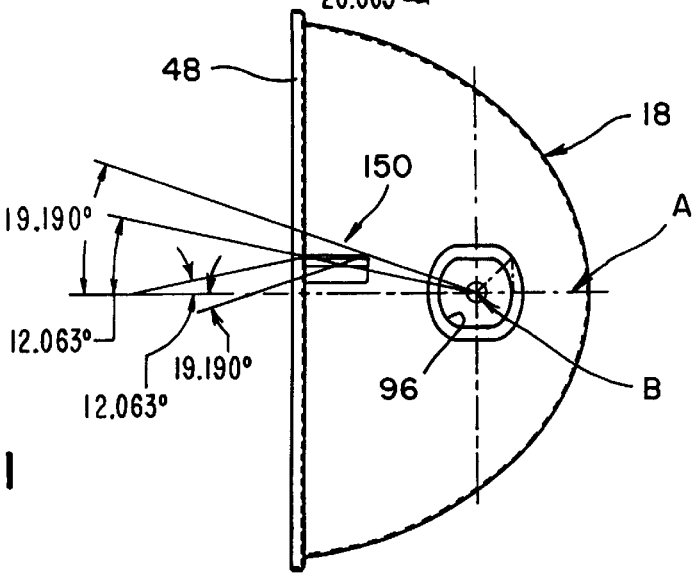
FIG. 31 is a side diagrammatical elevational view of the center arc-shaped louver mounted within the bowl-shaped reflector of the lighting fixture illustrated in FIGS. 1–4.

When center arc-shaped louver 150 is connected to lower middle arc-shaped louver 148, central arc-shaped louver 150 extends approximately 153.382° about main or central aiming axis A of reflector 18 as illustrated in FIG. 29. Center arc-shaped louver 144 has an inner surface 236 facing radially inwardly towards central aiming axis A of reflector 18, and an outer surface 238 facing radially outwardly from central aiming axis A of reflector 18. Preferably, center arc-shaped louver 150 is arranged such that its planar segments 224 extends substantially parallel to the central aiming axis A of reflector 18 as inner and outer surfaces 236 and 238 approach open front 84 of reflector 18.

Inner surface 236 has a specular finish which is designed to redirect light rays from lamp 12 downwardly back into the main beam that would otherwise normally escape into the glare zone. Outer surface 238, on the other hand, has preferably a light absorbing finish so that substantially no light is reflected by outer surface 238. For example, outer surface 238 can be painted with a high temperature black paint.

Referring now to supports 152, 154 and 156 as best seen in FIG. 1, vertical support 152 and horizontal supports 154 and 156 are preferably coupled to interior surface 80 of reflector 18 via L-shaped brackets 240 and fasteners 242. Preferably, fasteners 242 are nut and bolt arrangements with lock washers for removably securing upper louver assembly 240 to inner surface 80 of reflector 18. Of course, it will be apparent to those skilled in the art from this disclosure that other types of fasteners could be utilized to either removably or permanently secure upper louver assembly 140 to reflector 18. As seen in FIG. 19, supports 152, 154 and 156 preferably have a plurality of fastener holes 243 to allow supports 152, 154 and 156 to be adjusted for installation into various sizes of bowl-shaped reflectors.

First Alternate Upper Louver Assembly 140'

Figure 32:
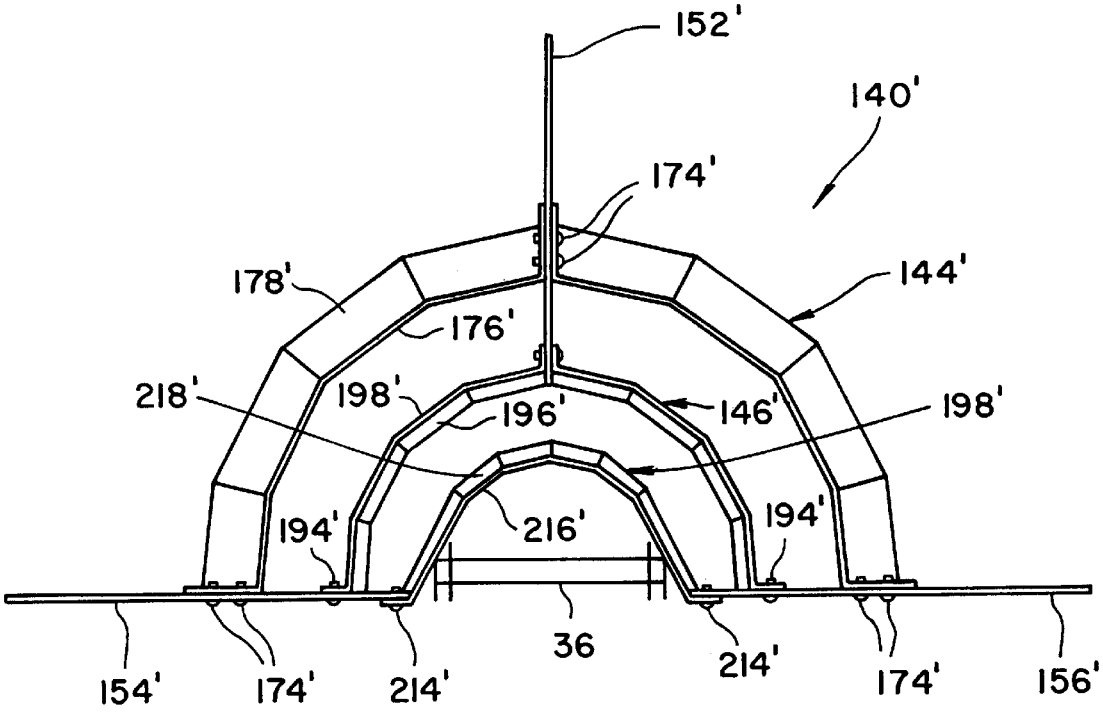
FIG. 32 is a front elevational view of a first alternate embodiment of the upper louver assembly prior to being installed within the bowl-shaped reflector of the lighting fixture illustrated in FIGS. 1–4.
Figure 33:
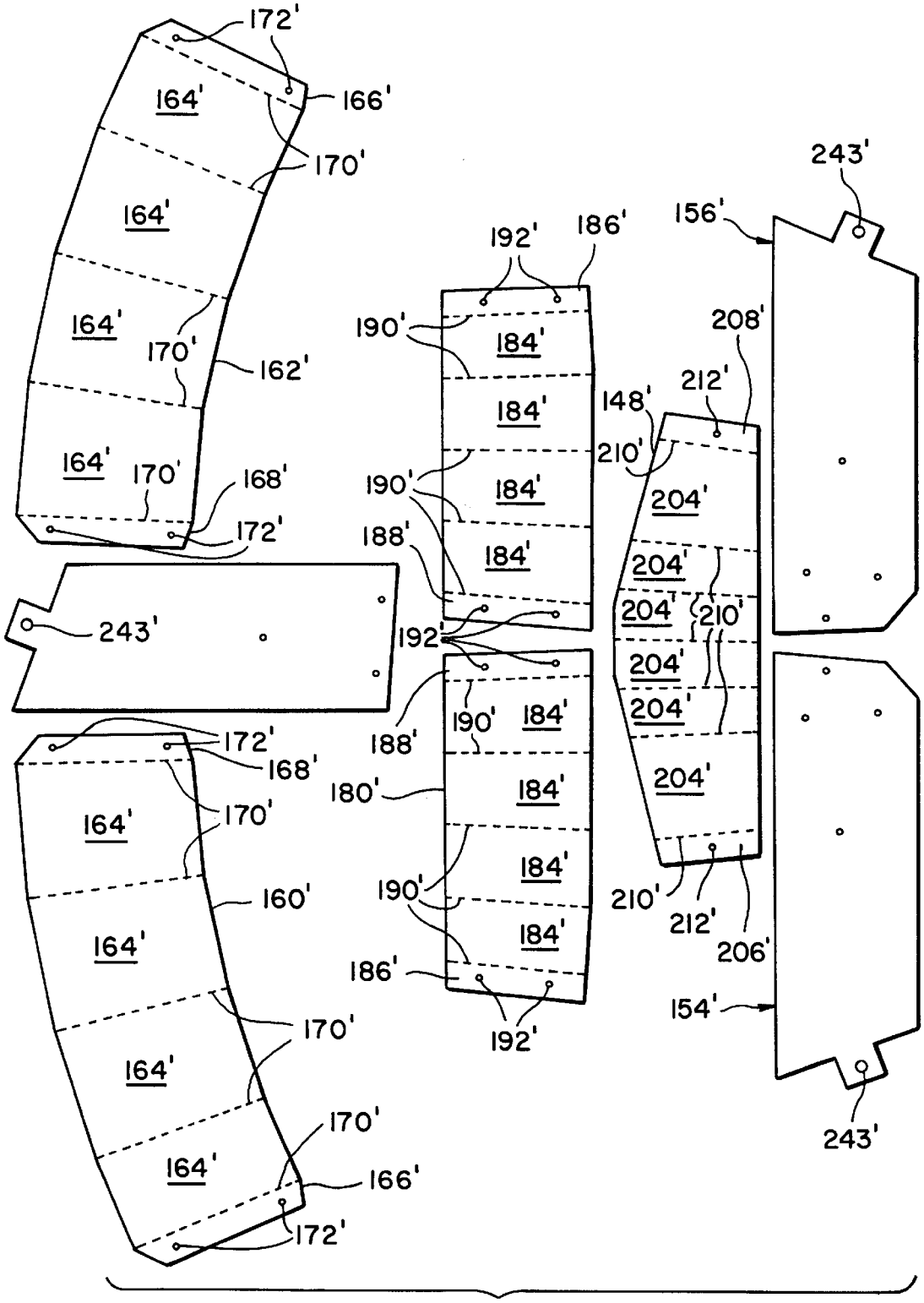
FIG. 33 is a top plan view of the first alternate embodiment of the upper louver assembly illustrated in FIG. 32, prior to being bent and assembled within the bowl-shaped reflector of the lighting fixture illustrated in FIGS. 1–4.

Referring now to FIGS. 32 and 33, a first alternate embodiment of the upper louver assembly 140' is illustrated for use with glare and spill control assembly 22. More specifically, upper louver assembly 140' is similar to upper louver assembly 140 which is discussed above, except that the center arc-shaped louver 150 has been eliminated from upper louver assembly 140' and lower middle arc-shaped louver 148 has been modified so that its inner surface 196' has been angled inwardly as it approaches the open front 84 of lighting fixture 10.

Since upper louver assembly 140' is similar to upper louver assembly 140, as discussed above, louver assembly 140' will not be discussed or illustrated in detail herein. Rather, it will be apparent to those skilled in the art from this disclosure that the construction of upper louver assembly 140 also applies to the construction of upper louver assembly 140'. Moreover, similar reference numerals will be used with primes (') to indicate similar parts or elements.

Basically, upper louver assembly 140' includes an outermost arc-shaped louver or baffle 144', an upper middle arc-shaped louver 146', and a lower middle arc-shaped louver 148'. Arc-shaped louvers 144', 146' and 148' are preferably concentrically arranged about the main or central aiming axis A of reflector 18. Arc-shaped louvers 144', 146' and 148' are fixedly connected to interior surface 80 of bowl-shaped reflector 18 via a vertical louver support 152' and a pair of horizontal louver supports 154' and 156'.

Outermost arc-shaped louver 144' is preferably a two-piece construction having a first arc-shaped member 160' and a second substantially identical arc-shaped member 162' which is the mirror image of first arc-shaped member 160'. Each of the arc-shaped members 160' and 162' has four planar segments 164' and a pair of mounting tabs 166' and 168' for coupling arc-shaped members 160' and 162' to louver supports 152', 154' and 156'.

More specifically, each of the first and second arc-shaped members 160' and 162' are bent along fold lines 170' to form an angled arc-shaped member with the four planar segments 164' and mounting tabs 166' and 168'.

Each of the mounting tabs 166' and 168' has a pair of holes 172' for receiving fasteners 174' to fixedly secure first and second members 160' and 162' of outermost arc-shaped louver 144' to supports 152', 154' and 156'.

Outermost arc-shaped louver 144' has an inner surface 176' facing radially inwardly towards central aiming axis A of reflector 18, and an outer surface 178' facing radially outwardly from central aiming axis A of reflector 18. Preferably, outermost arc-shaped louver 144' is angled radially inwardly towards central aiming axis A as inner and outer surfaces 176' and 178' approach open front 84 of reflector 18. In other words, outermost arc-shaped louver 144' is angled radially inwardly as inner and outer surfaces 176' and 178' extend away from interior surface 80 of reflector 18 towards open front 84 of reflector 18.

Inner surface 176' has a non-specular finish, which preferably has a light absorbing finish thereon. For example, inner surface 176' can be painted black with a high temperature paint. Accordingly, inner surface 176' of outermost arc-shaped louver 144' is designed to block light emitted by lamp 12' from radiating outwardly into the glare zone. Outer surface 178' is a plain non-specular surface.

Each of the planar segments 164' of outermost arc-shaped louver 144' is preferably angled relative to reflector 18 such that the light rays reflected from reflector 18 pass substantially parallel to planar segments 164'. In other words, the reflected light rays from reflector 18 which pass adjacent to inner or outer surfaces 176' and 178' are substantially parallel to inner and outer surfaces 176' and 178' such that outermost arc-shaped louver 144' does not substantially obstruct the reflected light rays from reflector 18. Rather, only the light rays which are directly emitted from lamp 12 are blocked or absorbed by inner surface 176' of planar segments 164'.

Upper arc-shaped middle louver 146' is also a two-piece construction having a first arc-shaped member 180' and a second arc-shaped member 182' which is substantially identical to first member 180' but the mirror image thereof. Each of the first and second members 180' and 182' has four planar segments 184' and a pair of mounting tabs 186' and 188'.

Planar segments 184' and tabs 186' and 188' are formed by bending the metal sheet forming first and second arc-shaped members 180' and 182' into a pair of substantially arc-shaped members with outwardly extending mounting tabs 186' and 188'. Each of the mounting tabs 186' and 188' has a pair of fastener holes 192' for receiving fasteners 194' to fixedly couple upper middle louver 146' to supports 152', 154' and 156' Upper middle arc-shaped louver 146' has an inner surface 196' facing radially inwardly towards center aiming axis A, and an outer surface 198' facing radially outwardly from central aiming axis A of reflector 18. Preferably, inner surface 196' is a reflective surface with a specular finish for redirecting the light rays, which are directly emitted from lamp 12, back downwardly towards and across the central aiming axis A. These redirected light rays which are reflected downwardly by upper middle arc-shaped louver 146' would normally escape into the glare zone but for upper middle arc-shaped louver 146'. Accordingly, upper middle arc-shaped louver 146' redirects light rays which would otherwise be lost into the glare zone back into the main beam of light. Outer surface 198' preferably has a light absorbing finish so that substantially no light is reflected by outer surface 198'.

In contrast to outermost arc-shaped louver 144', upper middle arc-shaped louver 146' is angled to diverge away from central aiming axis A of reflector 18. More specifically, each of the planar segments 194' of upper middle arc-shaped louver 146' is angled relative to central aiming axis A such that as inner and outer surfaces 196' and 198' of planar segments 194' approach open front 84 of reflector 18 as they diverge away from central aiming axis A. In other words, planar segments 194' are directed radially downwardly towards central aiming axis A as they approach towards the rear of reflector 18.

Lower middle arc-shaped louver 148' is preferably constructed as a one-piece, unitary member from a single sheet of material, which is bent to form six planar segments 204' and a pair of mounting tabs 206' and 208'. More specifically, the sheet material forming lower middle arc-shaped louver 148' is bent along fold lines 210' such that the six planar segments 204' form an angled arc-shaped member with mounting tabs 206' and 208' extending radially outwardly from the ends of lower middle arc-shaped louver 148'. In other words, planar segments 204' are angled relative to each other to form an arc, which is arranged about central aiming axis A.

Each of the mounting tabs 206' and 208' has a pair of mounting holes 212' for receiving fasteners 214' to fixedly secure lower middle arc-shaped louver 148' horizontal supports 154' and 156'.

Lower middle arc-shaped louver 148' has an inner surface 216' facing radially inwardly towards central aiming axis A of reflector 18 and an outer surface 218' facing radially outwardly from central aiming axis A of reflector 18. Preferably, lower middle arc-shaped louver 148' is angled to converge downwardly towards the central aiming axis A of reflector 18 as inner and outer surfaces 216' and 218' approach open front 84 of reflector 18.

Inner surface 216' has a specular finish which is designed to redirect light rays from lamp 12 downwardly back into the main beam that would otherwise normally escape into the glare zone. Outer surface 218' has preferably a light absorbing finish so that substantially no light is reflected by outer surface 218'. For example, outer surface 218' can be painted with a high temperature black paint.

Second Alternate Upper Louver Assembly 140"

Figure 34:
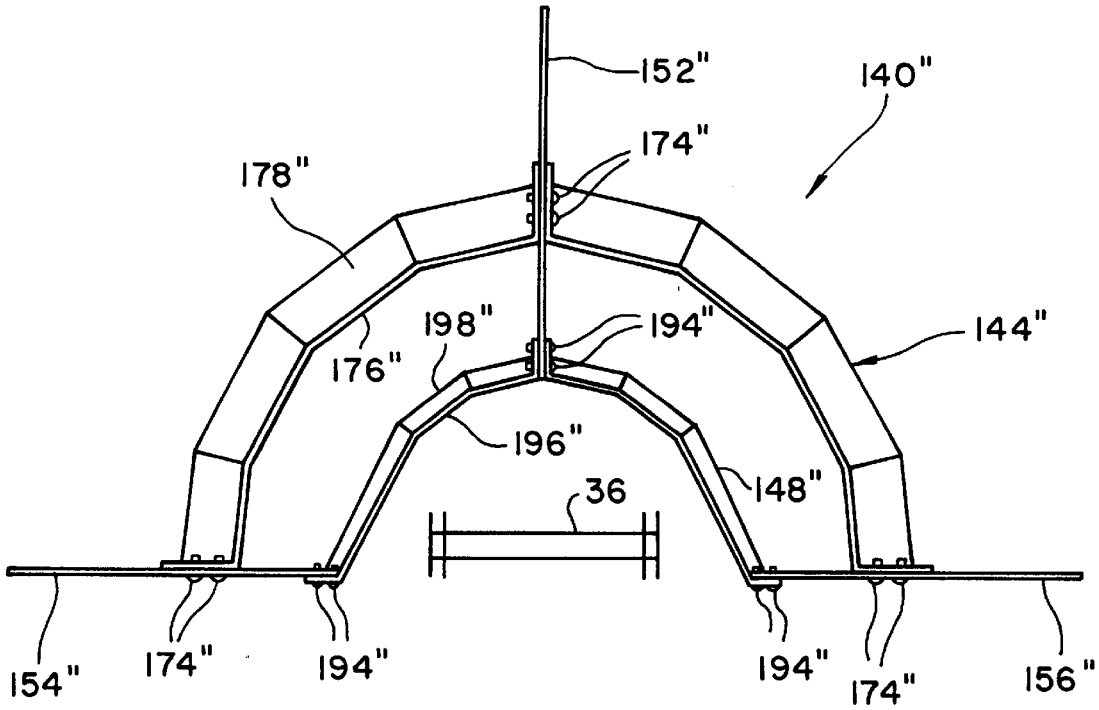
FIG. 34 is a front elevational view of a second alternate embodiment of the upper louver assembly prior to being installed into the bowl-shaped reflector of the lighting fixture, illustrated in FIGS. 1–4.
Figure 35:
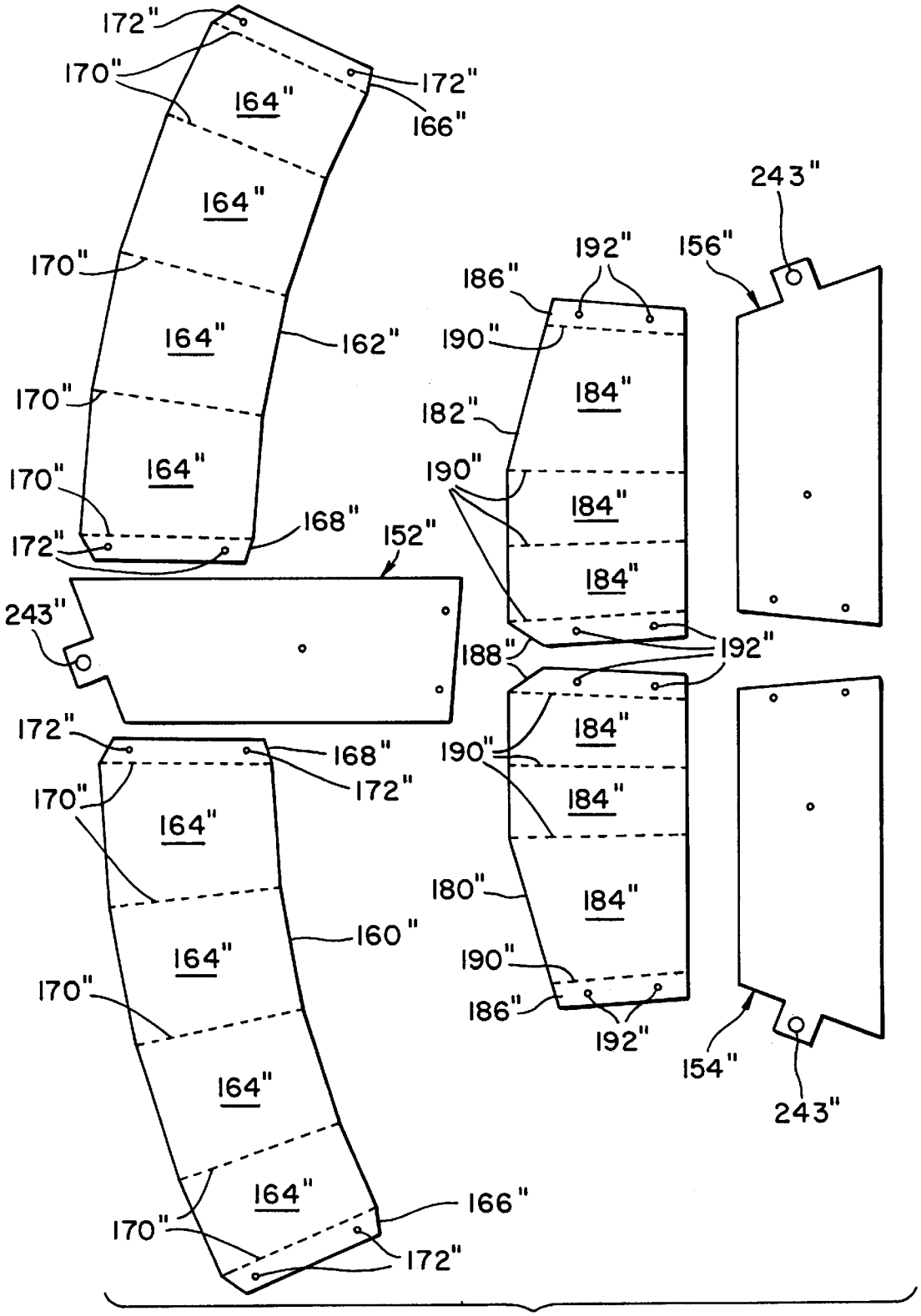
FIG. 35 is a top plan view of the second alternate embodiment of the upper louver assembly illustrated in FIG. 34 prior to being bent and assembled within the bowl-shaped reflector of the lighting fixture illustrated in FIGS. 1–4.

Referring now to FIGS. 34 and 35, a second alternate upper louver assembly 140" is illustrated in accordance with the present invention. Upper louver assembly 140" is similar to upper louver assembly 140 discussed above. However, upper louver assembly 140" utilizes only a pair of arc-shaped louvers 144" and 148".

Accordingly, similar parts or elements of upper louver assembly 140' will be given the same reference numeral as upper louver assembly 140, but with a double-prime (").

Outermost arc-shaped louver or baffle 144" is substantially identical to the outermost arc-shaped louvers 144 and 144' of upper louver assemblies 140 and 140' as discussed above. Accordingly, outermost arc-shaped louver 144" will not be discussed or illustrated in detail herein.

Outermost arc-shaped louver 144" is preferably a two-piece construction having a first arc-shaped member 160" and a second substantially identical arc-shaped member 162" which is the mirror image of first arc-shaped member 160". Each of the arc-shaped members 160" and 162" has four planar reflector segments 164" and a pair of mounting tabs 166" and 168" extending from their ends for coupling arc-shaped members 160" and 162" to louver supports 152", 154" and 156".

The second arc-shaped louver 148" is somewhat of a hybrid of the arc-shaped louvers 146 and 148 of upper louver assembly 140. More specifically, arc-shaped louver 148" is preferably a two-piece construction having a first arc-shaped member 182" and a second arc-shaped member 180" which is substantially identical to first arc-shaped member 180" but the mirror image thereof. Each of the first and second arc-shaped members 180" and 182" has three planar reflector segments 184" and a pair of mounting tabs 186" and 188". As seen in FIG. 35, planar segments 184" and tabs 186" and 188" are formed by bending the sheet metal along fold lines 190" to form first and second arc-shaped members 180" and 182" and a pair of substantially arc-shaped members with outwardly extending mounting tabs 182" and 188".

Each of the mounting tabs 186" and 188" has a pair of fastener holes 192" for receiving fasteners 194" to fixedly couple louver 148" to supports 152", 154" and 156". Arc-shaped louver 148" has an inner surface 196" facing radially inwardly towards the center aiming axis A of reflector 18, and an outer surface 198" facing radially outwardly from central aiming axis A of reflector 18.

Preferably, inner surface 196" is a reflective surface with a specular finish for redirecting the light rays which are directly emitted from lamp 12, back downwardly towards and across the central aiming axis A of reflector 18. These reflected light rays which are reflected downwardly by louver 148" would normally escape into the glare zone but for louver 148". Accordingly, louver 148" redirects light rays which otherwise would be lost into the glare zone back into the mainstream of light. Outer surface 198", on the other hand, has a light absorbing finish so that substantially no light is reflected by outer surface 198".

Similar to outermost arc-shaped louver 144", arc-shaped louver 148" is also angled radially inwardly towards central aiming axis A of reflector 18 as inner and outer surfaces 196" and 198" approach front 84 of reflector 18. In other words, arc-shaped louver 148" is angled radially inwardly as inner and outer surfaces 196" and 198" extend away from interior surface 80 of reflector 18 towards front 84 of reflector 18.

Louver supports 152", 154" and 156" are similar in construction to louver supports 152, 154 and 156 discussed above, but only have a single mounting hole 243" for coupling to reflector 18. Thus, louver supports 152", 154" and 156" will not be discussed or illustrated herein. Rather, it will be apparent to one skilled in the art from this disclosure that the construction of louver supports 152, 154 and 156 as discussed above also applies to the construction of louver supports 152", 154"' and 156".

Reflector Insert Assembly 142

Referring now to FIGS. 1 and 36–40, reflector insert assembly 142 includes six substantially identical trapezoidal reflector elements 250 which are coupled to interior surface 80 of bowl-shaped reflector 18 via a pair of support brackets 252. Specifically, support brackets 252 are fastened to the interior surface 80 of reflector 18 via conventional fasteners (not shown). Fasteners for brackets 252 can be conventional screws, rivets or nuts and bolts as needed and/or desired.

Figure 36:
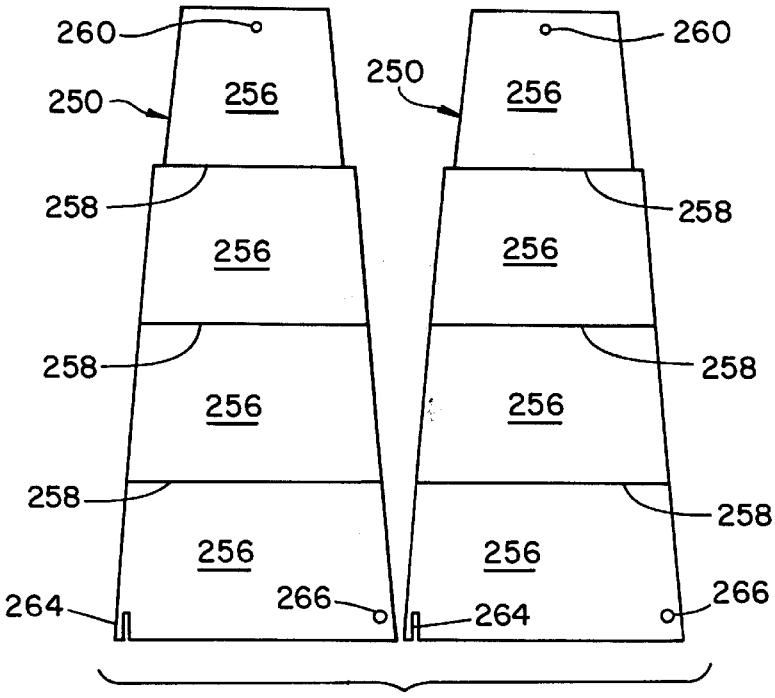
FIG. 36 is an exploded elevational view of a pair of reflector elements for the reflector insert assembly of the glare and spill control assembly for the lighting fixture illustrated in FIGS. 1–4.
Figure 38:
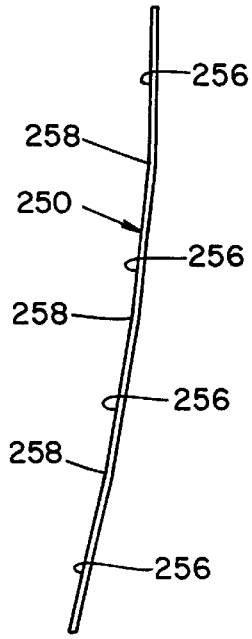
FIG. 38 is a side elevational view of one of the reflector elements illustrated in FIGS. 36 and 37 for the glare and spill control assembly of the lighting fixture illustrated in FIGS. 1–4.
Figure 37:
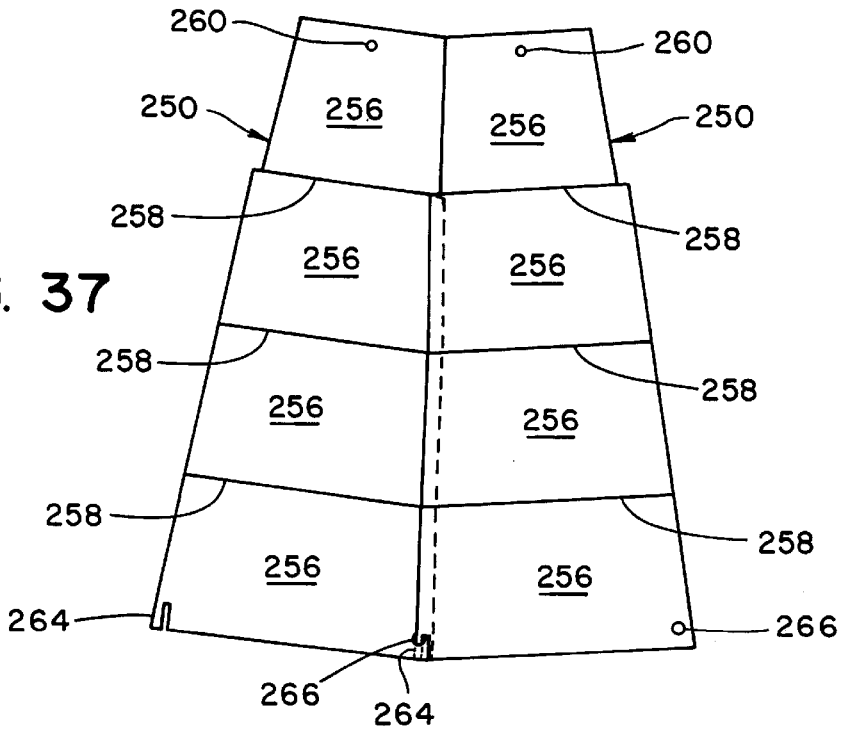
FIG. 37 is a front elevational view of the pair of reflector elements illustrated in FIG. 36 after being coupled together.

As mentioned above, reflector elements 250 are each substantially identical, and are bent along three transverse fold lines 258 to form a somewhat curved-shaped member with four planar reflective segments 256 per reflector element 250. Specifically, as seen in FIGS. 36–38, fold lines 258 extend substantially perpendicular to the altitude of the trapezoidal reflector element 250. Each of the reflector elements 250 has a mounting hole 260 at its upper edge for receiving a fastener to secure reflector element 250 to one of the support brackets 252 as seen in FIG. 1. Also, each of the reflector elements 250 has a bendable tab 264 at one of its bottom corners, and a tab receiving hole 266 at its other bottom corner. The tab 264 of the reflector elements 250 are designed to be bent and inserted into the tab receiving hole 266 of an adjacent reflector element 250 such that the bottom adjacent corners of reflector elements 250 are interconnected with adjacent edges of reflector elements 250 overlapping. This arrangement forms a substantially continuous parabolic reflector insert constructed of a plurality of planar segments 256.

Figure 39:
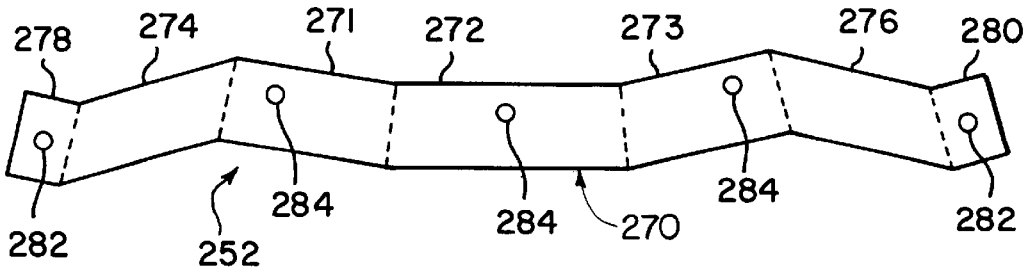
FIG. 39 is a top plan view of the mounting bracket for supporting and coupling the reflector elements of the reflector insert assembly for the glare and spill control assembly of the lighting fixture illustrated in FIGS. 1–4, prior to being bent and coupled within the bowl-shaped reflector of the lighting fixture illustrated in FIGS. 1–4.
Figure 40:
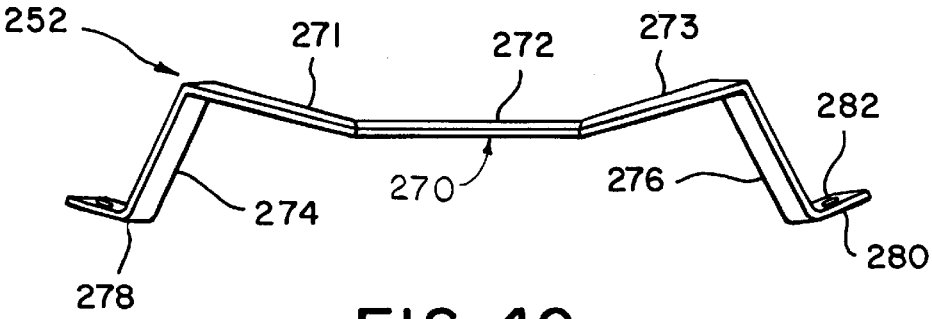
FIG. 40 is an elevational view of the mounting bracket illustrated in FIG. 37 after being bent, but prior to being coupled to the bowl-shaped reflector of the lighting fixture illustrated in FIGS. 1–4.

Referring now to one of the support brackets 252 as seen in FIGS. 39 and 40, support brackets 252 are each substantially identical and each includes a center mounting portion 270 with three planar sections 271–273, and a pair of legs 274 and 276 with mounting tabs 278 and 280, respectively. Each of the mounting tabs 278 and 280 has a fastener hole 282 for receiving a fastener therethrough to secure support brackets 252 to interior surface 80 of reflector 18. Each of the planar sections 272–273 of each of the support brackets 252 is designed to support the upper end of the reflective elements 250. Moreover, each of the planar sections 271–273 has a fastener hole 284 for securing the upper end of reflective elements 250 thereto via a fastener 262.

Figure 41:
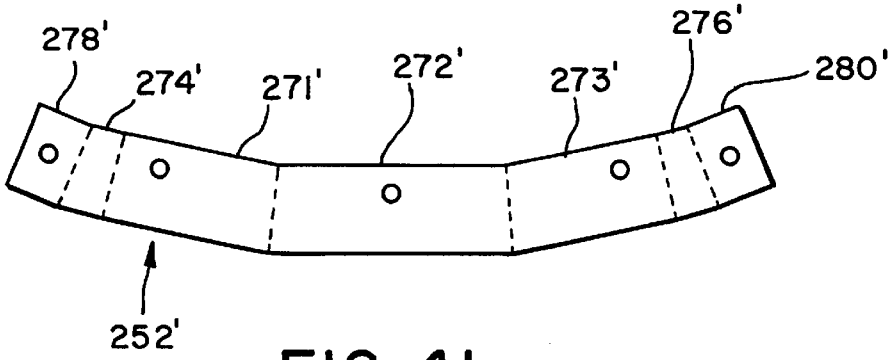
FIG. 41 is an alternative version of the mounting bracket of the reflector insert assembly for the glare and spill control assembly, prior to being bent and installed in the bowl-shaped reflector of the lighting fixture illustrated in FIGS. 1–4.
Figure 42:
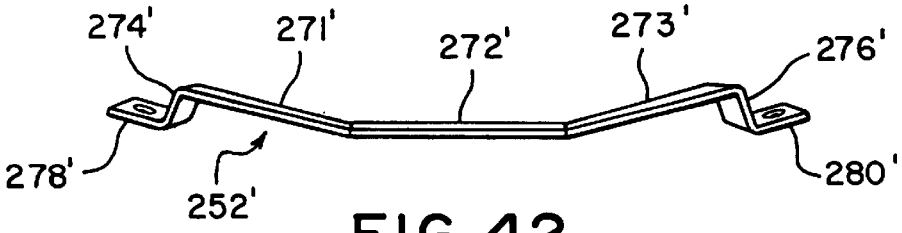
FIG. 42 is an elevational view of the alternate mounting bracket illustrated in FIG. 41 for the reflector insert of the glare and spill control assembly, after being bent but prior to being mounted in the bowl-shaped reflector of the lighting fixture illustrated in FIGS. 1–4.

An alternate support bracket 252' is illustrated in FIG. 41 and 42 which is substantially identical to support bracket 252, except that legs 274' and 276' of bracket 252' are shorter than legs 274 and 276 of bracket 252. Accordingly, the angle of the reflected light rays from reflector elements 250 will intersect central aiming axis A of reflector 18 closer to front 84 of reflector 18 when using brackets 252' rather than when using brackets 252.

Similar to brackets 252, each of the brackets 252' includes a center mounting portion 270' with three planar sections 271'–273', and a pair of legs 274' and 276' with mounting tabs 278' and 280' respectively. Each of the mounting tabs 278' and 280' has a mounting hole for receiving a fastener to attach bracket 252' to bowl-shaped reflector 18. Since bracket 252' is similar to bracket 252, bracket 252' will not be illustrated or discussed in detail herein.

Light Absorbing Baffle 290

Figure 43:
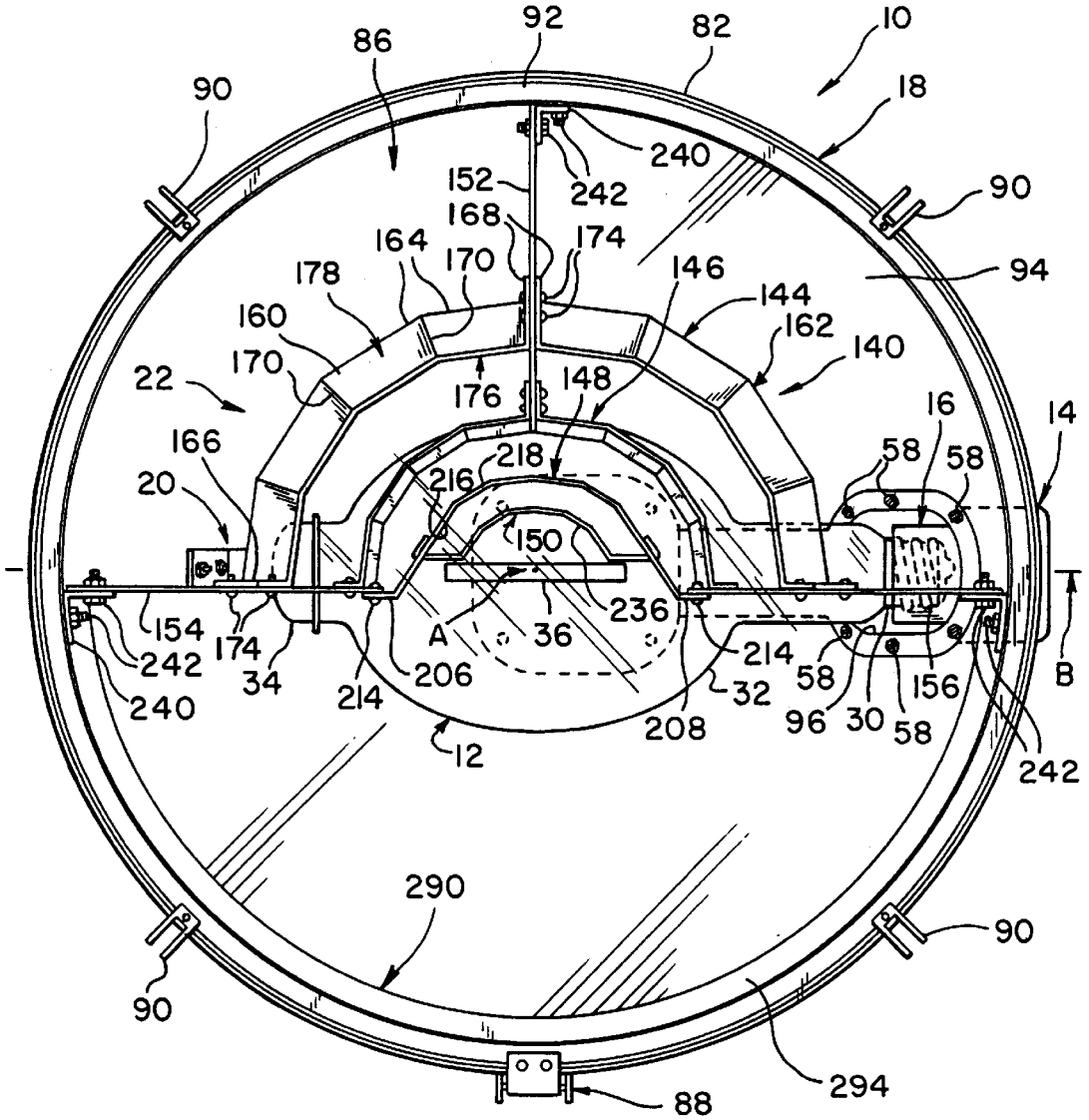
FIG. 43 is a front elevational view of an alternative embodiment of the glare and spill control assembly illustrated in FIGS. 1–4, wherein the reflector insert has been replaced with a light absorbing baffle.

As seen in FIG. 43, a light absorbing baffle 290 is illustrated as being attached to bowl-shaped reflector 18 of lighting fixture 10. More specifically, reflector insert assembly 142 has been removed and replaced with baffle 290. Baffle 290 is designed to absorb some of the light emitted from lamp 12 which would otherwise be reflected off the bottom or lower hemisphere of reflector 18 into the glare zone and/or the main beam of light. Thus, baffle 290 is designed to reduce glare and to narrow the beam of light radiating from lighting fixture 10. Baffle 290 is a rectangular sheet metal member which is flexed to form a curve.

Baffle 290 is a rectangular sheet metal member which is flexed to form a curve. Baffle 290 extends approximately 180° along the peripheral edge of inner surface 84 and attached thereto by fasteners 242. Basically, inner surface 294 has a light absorbing finish. For example, inner surface 294 can be painted with a high temperature black paint so as to absorb light rays from lamp 12. Baffle 290 preferably has a width of about 2 ½ inches. Of course, it would understood to those skilled in the art from this disclosure that the width of baffle 290 will depend upon the particular application of lighting fixture 10. In other words, the width of baffle 290 can be larger to absorb more light or smaller to absorb less light.

Other objects, advantages and salient features of the present invention will become apparent to those skilled in the art from the following detailed description, which, taken in conjunction with the annexed drawings, discloses preferred embodiments of the present invention.

What is claimed is:

1. A lighting fixture for lighting an area, comprising:

a single-ended lamp having a longitudinal axis extending from a base section to a bulb section;

a bowl-shaped reflector having an interior reflective surface with a central aiming axis and a front peripheral edge defining a front opening;

a lamp mounting socket fixedly coupled to said reflector and electrically coupled to said base section of said lamp for supporting said lamp within said reflector said lamp mounting socket being spaced from said central aiming axis;

a lens cover coupled to said reflector for covering said front opening of said reflector to protect said lamp from weather; and a glare and spill control assembly coupled to said interior reflective surface of said reflector and behind said lens cover, said glare and spill control assembly including a first arc-shaped louver having an outer surface and an inner surface, said first louver being angled inwardly towards said central aiming axis of said reflector as said first louver approaches said lens cover.

2. A lighting fixture according to claim 1, wherein said lamp mounting socket is offset from said central aiming axis of said reflector such that said longitudinal axis of said lamp extends substantially perpendicular to said central aiming axis of said reflector.

3. A lighting fixture according to claim 2, wherein said inner surface of said first louver has a light absorbing finish.

4. A lighting fixture according to claim 3, wherein said first louver is angled relative to said interior surface of said reflector and said lamp such that a portion of reflected light produced by said lamp and reflected from said interior surface of said reflector passes substantially parallel to said inner and outer surfaces of said first louver.

5. A lighting fixture according to claim 4, wherein said first louver extends at least approximately 180° about said central aiming axis of said reflector.

6. A lighting fixture for lighting an area, comprising:

a single-ended lamp having a longitudinal axis extending from a base section to a bulb section;

a bowl-shaped reflector having an interior reflective surface with a central aiming axis and a front peripheral edge defining a front opening;

a lamp mounting socket fixedly coupled to said reflector and electrically coupled to said base section of said lamp for supporting said lamp within said reflector;

a lens cover coupled to said reflector for covering said front opening of said reflector to protect said lamp from weather; and a glare and spill control assembly coupled to said interior reflective surface of said reflector and behind said lens cover, said glare and spill control assembly including a first arc-shaped louver having an outer surface and an inner surface, said first louver being paneled inwardly towards said central aiming axis of said reflector as said first louver approaches said lens cover, said lamp mounting socket being offset from said central aiming axis of said reflector such that said longitudinal axis of said lamp extends substantially perpendicular to said central aiming axis of said reflector, said inner surface of said first louver having a light absorbing finish, said first louver being angled relative to said interior surface of said reflector and said lamp such that a portion of reflected light produced by said lamp and reflected from said interior surface of said reflector passes substantially parallel to said inner and outer surfaces of said first louver, said glare and spill control assembly further including a second arc-shaped louver having an outer surface and an inner surface, said second louver being spaced inwardly from said first louver towards said central aiming axis.

7. A lighting fixture according to claim 6, wherein said outer and inner surfaces of said second louver are angled inwardly towards said central aiming axis of said reflector as said second louver approaches said lens cover.

8. A lighting fixture according to claim 7, wherein said inner surface of said second louver has a reflective finish.

9. A lighting fixture according to claim 8, wherein said arc-shaped louvers are formed by a plurality of substantially planar segments.

10. A lighting fixture according to claim 8, wherein said first and second louvers extend through arcs of at least approximately 180°.

11. A lighting fixture according to claim 6, wherein said outer and inner surfaces of said second louver are angled outwardly away from said central aiming axis of said reflector as said second louver approaches said lens cover.

12. A lighting fixture according to claim 11, wherein said inner surface of said second louver has a reflective finish.

13. A lighting fixture according to claim 12, wherein said arc-shaped louvers are formed by a plurality of substantially planar segments.

14. A lighting fixture according to claim 13, wherein said first and second louvers extend through arcs of at least approximately 180°.

15. A lighting fixture for lighting an area, comprising:

a single-ended lamp having a longitudinal axis extending from a base section to a bulb section;

a bowl-shaped reflector having an interior reflective surface with a central aiming axis and a front peripheral edge defining a front opening;

a lamp mounting socket fixedly coupled to said reflector and electrically coupled to said base section of said lamp for supporting said lamp within said reflector;

a lens cover coupled to said reflector for covering said front opening of said reflector to protect said lamp from weather; and a glare and spill control assembly coupled to said interior reflective surface of said reflector and behind said lens cover, said glare and spill control assembly including a first arc-shaped louver having an outer surface and an inner surface, said first louver being angled inwardly towards said central aiming axis of said reflector as said first louver approaches said lens cover, said lamp mounting socket being offset from said central aiming axis of said reflector such that said longitudinal axis of said lamp extends substantially perpendicular to said central aiming axis of said reflector, said inner surface of said first louver having a light absorbing finish, said first louver being angled relative to said interior surface of said reflector and said lamp such that a portion of reflected light produced by said lamp and reflected from said interior surface of said reflector passes substantially parallel to said inner and outer surfaces of said first louver, said glare and spill control assembly further including a second arc-shaped louver having an outer surface and an inner surface said second louver being spaced inwardly from said first louver towards said central aiming axis, said outer and inner surfaces of said second louver extending substantially parallel to said central aiming axis to redirect light from said lamp towards said central aiming axis.

16. A lighting fixture according to claim 15, wherein said inner surface of said second louver has a reflective finish.

17. A lighting fixture according to claim 16, wherein said arc-shaped louvers are formed by a plurality of substantially planar segments.

18. A lighting fixture according to claim 17, wherein said first and second louvers extend through arcs of at least approximately 180°.

19. A lighting fixture according to claim 5, wherein said glare and spill control assembly further includes an internal reflector insert coupled to said interior surface of said reflector substantially opposite said first louver and angled to reflect light more parallel to said central aiming axis.

20. A lighting fixture according to claim 19, wherein said reflector insert is a substantially parabolic reflector insert formed by a plurality of substantially planar segments.

21. A lighting fixture according to claim 20, wherein said reflector insert extends approximately 120° relative to said central aiming axis.

22. A lighting fixture according to claim 21, wherein said reflector insert is constructed of a plurality of trapezoidal reflector elements with each of said reflector elements having an altitude and being bent substantially perpendicular to said altitude, respectively.

23. A lighting fixture for lighting an area, comprising:

a single-ended lamp having a longitudinal axis extending from a base section to a bulb section;

a bowl-shaped reflector having an interior reflective surface with a central aiming axis and a front peripheral edge defining a front opening;

a lamp mounting socket fixedly coupled to said reflector and electrically coupled to said base section of said lamp for supporting said lamp within said reflector;

a lens cover coupled to said reflector for covering said front opening of said reflector to protect said lamp from weather; and a glare and spill control assembly coupled to said interior reflective surface of said reflector and behind said lens cover, said glare and spill control assembly including a first arc-shaped louver having an outer surface and an inner surface, said first louver being angled inwardly towards said central aiming axis of said reflector as said first louver approaches said lens cover, said lamp mounting socket being offset from said central aiming axis of said reflector such that said longitudinal axis of said lamp extends substantially perpendicular to said central aiming axis of said reflector, said inner surface of said first louver having a light absorbing finish, said first louver being angled relative to said interior surface of said reflector and said lamp such that a portion of reflected light produced by said lamp and reflected from said interior surface of said reflector passes substantially parallel to said inner and outer surfaces of said first louver, said glare and spill control assembly further including a second arc-shaped louver having an outer surface and an inner surface, said second louver being spaced inwardly from said first louver towards said central aiming axis, said outer and inner surfaces of said second louver being angled inwardly towards said central aiming axis of said reflector as said second louver approaches said lens cover, said glare and spill control assembly further including a third arc-shaped louver spaced inwardly from said first and second louvers towards said central aiming axis, said third louver having an inner surface and an outer surface.

24. A lighting fixture according to claim 23, wherein said inner and outer surfaces of said third louver are angled inwardly towards said central aiming axis of said reflector as said third louver approaches said lens cover.

25. A lighting fixture according to claim 24, wherein said inner surfaces of said second and third louvers have reflective finishes.

26. A lighting fixture according to claim 25, wherein said outer surfaces of said second and third louvers have light absorbing finishes.

27. A lighting fixture according to claim 25, wherein said first, second and third arc-shaped louvers are formed by a plurality of substantially planar segments.

28. A lighting fixture according to claim 23, wherein said inner and outer surfaces of said third louver extend in a direction substantially parallel to said central aiming axis to redirect light from said lamp towards said central aiming axis.

29. A lighting fixture according to claim 28, wherein said inner surfaces of said second and third louvers have reflective finishes.

30. A lighting fixture according to claim 29, wherein said outer surfaces of said second and third louvers have light absorbing finishes.

31. A lighting fixture according to claim 30, wherein said first, second and third arc-shaped louvers are formed by a plurality of substantially planar segments.

32. A lighting fixture according to claim 31, wherein said glare and spill control assembly further includes an internal reflector insert coupled to said interior surface of said reflector substantially opposite said first louver and angled to reflect light more parallel to said central aiming axis.

33. A lighting fixture according to claim 32, wherein said reflector insert extends approximately 120° relative to said central aiming axis.

34. A lighting fixture according to claim 33, wherein said reflector insert is constructed of a plurality of trapezoidal reflector elements with each of said reflector elements having an altitude and being bent substantially perpendicular to altitude, respectively.

35. A lighting fixture according to claim 31, wherein said reflector insert is a substantially parabolic reflector insert formed by a plurality of substantially planar segments.

36. A lighting fixture for lighting an area, comprising:

a single-ended lamp having a longitudinal axis extending from a base section to a bulb section;

a bowl-shaped reflector having an interior reflective surface with a central aiming axis and a front peripheral edge defining a front opening;

a lamp mounting socket fixedly coupled to said reflector and electrically coupled to said base section of said lamp for supporting said lamp within said reflector;

a lens cover coupled to said reflector for covering said front opening of said reflector to protect said lamp from weather; and a glare and spill control assembly coupled to said interior reflective surface of said reflector and behind said lens cover, said glare and spill control assembly including a first arc-shaped louver having an outer surface and an inner surface, said first louver being angled inwardly towards said central aiming axis of said reflector as said first louver approaches said lens cover, said lamp mounting socket being offset from said central aiming axis of said reflector such that said longitudinal axis of said lamp extends substantially perpendicular to said central aiming axis of said reflector, said inner surface of said first louver having a light absorbing finish, said first louver being angled relative to said interior surface of said reflector and said lamp such that a portion of reflected light produced by said lamp and reflected from said interior surface of said reflector passes substantially parallel to said inner and outer surfaces of said first louver, said glare and spill control assembly further including a second arc-shaped louver having an outer surface and an inner surface said second louver being spaced inwardly from said first louver towards said central aiming axis, said outer and inner surfaces of said second louver being angled inwardly towards said central aiming axis of said reflector as said second louver approaches said lens cover, said glare and spill control assembly further including a third arc-shaped louver spaced inwardly from said first and second louvers towards said central aiming axis, said third louver having an inner surface and an outer surface, said inner and outer surfaces of said third louver extending in a direction substantially parallel to said central aiming axis to redirect light from said lamp towards said central aiming axis, said inner surfaces of said second and third louvers having reflective finishes, said outer surfaces of said second and third louvers having light absorbing finishes, said first, second and third arc-shaped louvers being formed by a plurality of substantially planar segments, said glare and spill control assembly further including an arc-shaped light absorbing baffle coupled to said interior surface of said reflector along said front peripheral edge.

37. A lighting fixture according to claim 36, wherein said light absorbing baffle extends approximately 180° about said front peripheral edge of said reflector.

38. A lighting fixture for lighting an area, comprising:

a single-ended lamp having a longitudinal axis extending from a base section to a bulb section;

a bowl-shaped reflector having an interior reflective surface with a central aiming axis and a front peripheral edge defining a front opening;

a lamp mounting socket fixedly coupled to said reflector and electrically coupled to said base section of said lamp for supporting said lamp within said reflector;

a lens cover coupled to said reflector for covering said front opening of said reflector to protect said lamp from weather; and a glare and spill control assembly coupled to said interior reflective surface of said reflector and behind said lens cover, said glare and spill control assembly including a first arc-shaped louver having an outer surface and an inner surface, said first louver being angled inwardly towards said central aiming axis of said reflector as said first louver approaches said lens cover, said lamp mounting socket being offset from said central aiming axis of said reflector such that said longitudinal axis of said lamp extends substantially perpendicular to said central aiming axis of said reflector, said inner surface of said first louver having a light absorbing finish, said first louver being angled relative to said interior surface of said reflector and said lamp such that a portion of reflected light produced by said lamp and reflected from said interior surface of said reflector passes substantially parallel to said inner and outer surfaces of said first louver, said glare and spill control assembly further including a second arc-shaped louver having an outer surface and an inner surface, said second louver being spaced inwardly from said first louver towards said central aiming axis, said outer and inner surfaces of said second louver being angled inwardly towards said central aiming axis of said reflector as said second louver approaches said lens cover, said glare and spill control assembly further including a third arc-shaped louver spaced inwardly from said first and second louvers towards said central aiming axis, said third louver having an inner surface and an outer surface, said glare and spill control assembly further includes a fourth arc-shaped louver spaced inwardly from said first, second and third louvers towards said central aiming axis, said fourth louver having an inner surface and an outer surface.

39. A lighting fixture according to claim 38, wherein said inner and outer surfaces of said fourth louver extend in a direction substantially parallel to said central aiming axis to redirect light from said lamp towards said central aiming axis.

40. A lighting fixture according to claim 39, wherein said inner surfaces of said second, third and fourth louvers have reflective finishes.

41. A lighting fixture according to claim 40, wherein said outer surfaces of said second, third and fourth louvers have light absorbing finishes.

42. A lighting fixture according to claim 41, wherein said first, second, third and fourth louvers are formed by a plurality of substantially planar segments.

43. A lighting fixture according to claim 40, wherein said reflector insert is a substantially-parabolic reflector insert formed by a plurality of substantially planar segments.

44. A lighting fixture for lighting an area, comprising:

a single-ended lamp having a longitudinal axis extending from a base section to a bulb section;

a bowl-shaped reflector having an interior reflective surface with a central aiming axis and a front peripheral edge defining a front opening;

a lamp mounting socket fixedly coupled to said reflector and electrically coupled to said base section of said lamp for supporting said lamp within said reflector;

a lens cover coupled to said reflector for covering said front opening of said reflector to protect said lamp from weather; and a glare and spill control assembly coupled to said interior reflective surface of said reflector and behind said lens cover, said glare and spill control assembly including a first arc-shaped louver having an outer surface and an inner surface, said first louver being angled inwardly towards said central aiming axis of said reflector as said first louver approaches said lens cover, said lamp mounting socket being offset from said central aiming axis of said reflector such that said longitudinal axis of said lamp extends substantially perpendicular to said central aiming axis of said reflector, said inner surface of said first louver having a light absorbing finish, said first louver being angled relative to said interior surface of said reflector and said lamp such that a portion of reflected light produced by said lamp and reflected from said interior surface of said reflector passes substantially parallel to said inner and outer surfaces of said first louver, said glare and spill control assembly further including a second arc-shaped louver having an outer surface and an inner surface, said second louver being spaced inwardly from said first louver towards said central aiming axis, said outer and inner surfaces of said second louver being angled inwardly towards said central aiming axis of said reflector as said second louver approaches said lens cover, said glare and spill control assembly further including a third arc-shaped louver spaced inwardly from said first and second louvers towards said central aiming axis, said third louver having an inner surface and an outer surface, said glare and spill control assembly further including a fourth arc-shaded louver spaced inwardly from said first, second and third louvers towards said central aiming axis, said fourth louver having an inner surface and an outer surface, said inner and outer surfaces of said fourth louver extend in a direction substantially parallel to said central aiming axis to redirect light from said lamp towards said central aiming axis, said inner surfaces of said second, third and fourth louvers having reflective finishes, said glare and spill control assembly further including an arc-shaped light absorbing baffle coupled to said interior surface of said reflector along said front peripheral edge.

45. A lighting fixture according to claim 44, wherein said light absorbing baffle extends approximately 180° about said front peripheral edge of said reflector.

46. A lighting fixture for lighting an area, comprising:

a single-ended lamp having a longitudinal axis extending from a base section to a bulb section;

a bowl-shaped reflector having an interior reflective surface with a central aiming axis and a front peripheral edge defining a front opening;

a lamp mounting socket fixedly coupled to said reflector and electrically coupled to said base section of said lamp for supporting said lamp within said reflector, said lamp mounting socket being positioned to maintain said longitudinal axis of said lamp substantially perpendicular to said central aiming axis;

a lens cover coupled to said reflector for covering said front opening of said reflector to protect said lamp from weather; and a glare and spill control assembly coupled to said interior reflective surface of said reflector and behind said lens cover, said glare and spill control assembly comprising a first arc-shaped louver being angled outwardly away from said central aiming axis of said reflector as said first louver approaches said lens cover, a second arc-shaped louver being spaced inwardly from said first louver towards said central aiming axis, said second louver being angled inwardly towards said central aiming axis of said reflector as said second louver approaches said lens cover, a third arc-shaped louver spaced inwardly from said first and second louvers towards said central aiming axis, said third louver extending in a direction substantially parallel to said central aiming axis to redirect light from said lamp towards said central aiming axis, each of said arc-shaped louvers being positioned symmetrically about said central aiming axis.

47. A lighting fixture according to claim 28, wherein said outer and inner surfaces of said second louver are angled outwardly away from said central aiming axis of said reflector as said second louver approaches said lens cover.

48. A lighting fixture according to claim 39, wherein said outer and inner surfaces of said second louver are angled outwardly away from said central aiming axis of said reflector as said second louver approaches said lens cover, and said inner and outer surfaces of said third louver extend in a direction substantially parallel to said central aiming axis to redirect light from said lamp towards said central aiming axis.

49. A lighting fixture for lighting an area, comprising:

a single-ended lamp having a longitudinal axis extending from a base section to a bulb section;

a bowl-shaped reflector having an interior reflective surface with a central aiming axis and a front peripheral edge defining a front opening;

a lamp mounting socket fixedly coupled to said reflector and electrically coupled to said base section of said lamp for supporting said lamp within said reflector;

a lens cover coupled to said reflector for covering said front opening of said reflector to protect said lamp from weather; and a glare and spill control assembly coupled to said interior reflective surface of said reflector and behind said lens cover, said glare and spill control assembly including a first arc-shaped louver having an outer surface and an inner surface, said first louver being angled inwardly towards said central aiming axis of said reflector as said first louver approaches said lens cover, said glare and spill control assembly further including an arc-shape light absorbing baffle coupled to said interior surface of said reflector along said front peripheral edge.

* * * * *